US008177594B2

(12) United States Patent
Dagenais et al.

(10) Patent No.: US 8,177,594 B2
(45) Date of Patent: May 15, 2012

(54) WATERCRAFT REVERSE GATE OPERATION

(75) Inventors: Dominic Dagenais, Palm Bay, FL (US); Renald Plante, Rock Forest (CA); Andre Denis, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 328 days.

(21) Appl. No.: 12/508,041

(22) Filed: Jul. 23, 2009

(65) Prior Publication Data

US 2010/0022145 A1 Jan. 28, 2010

Related U.S. Application Data

(60) Provisional application No. 61/083,215, filed on Jul. 24, 2008.

(51) Int. Cl.
*B63H 11/11* (2006.01)

(52) U.S. Cl. ..... 441/1; 441/41

(58) Field of Classification Search ..... 440/1, 41
See application file for complete search history.

(56) References Cited

U.S. PATENT DOCUMENTS

| | | | | |
|---|---|---|---|---|
| 5,755,601 | A | 5/1998 | Jones | |
| 7,708,609 | B2 * | 5/2010 | Plante et al. | 440/41 |
| 2008/0133075 | A1 * | 6/2008 | St-Pierre et al. | 701/21 |
| 2008/0182463 | A1 | 7/2008 | St-Pierre et al. | |
| 2008/0233811 | A1 | 9/2008 | St-Pierre et al. | |
| 2009/0275248 | A1 * | 11/2009 | Plante et al. | 440/1 |

FOREIGN PATENT DOCUMENTS

WO 2008025169 A1 3/2008

* cited by examiner

*Primary Examiner* — Stephen Avila
(74) *Attorney, Agent, or Firm* — Osler Hoskin & Harcourt LLP

(57) ABSTRACT

A method of controlling a watercraft is disclosed which comprises actuating a reverse gate operator, sensing a speed of the watercraft, controlling a thrust generated by a jet propulsion system differently depending on whether the speed of the watercraft is above or below a predetermine watercraft speed when the reverse gate operator is actuated, and moving the reverse gate to a position in which the reverse gate redirects a jet of water expelled from the jet propulsion system in response to the actuation of the reverse gate operator. A watercraft implementing the above method is also disclosed.

38 Claims, 14 Drawing Sheets

WATERCRAFT REVERSE GATE OPERATION

CROSS-REFERENCE

The present application claims priority to U.S. Provisional Patent Application No. 61/083,215, filed on Jul. 24, 2008, and is related to U.S. patent application Ser. No. 11/961,650, filed Dec. 20, 2007, and U.S. Provisional Patent Application No. 60/871,698 filed on Dec. 22, 2006, the entirety of these three applications is incorporated herein by reference.

FIELD OF THE INVENTION

The present invention relates to watercraft having a reverse gate and methods of operating the reverse gate.

BACKGROUND OF THE INVENTION

In jet propelled watercraft, such as personal watercraft or sport boat, the watercraft can be propelled in reverse by lowering a reverse gate behind the output of the water jet thus redirecting the jet toward the front of the watercraft which creates a thrust in the reverse direction. The reverse gate is actuated by a hand activated reverse gate operator which, when pulled, lowers the reverse gate in front of the water jet. By actuating a throttle operator of the watercraft, the amount of thrust generated by the jet propulsion system changes. Therefore, by controlling the position of the reverse gate and the amount of thrust generated by the jet propulsion system, by actuating the reverse gate operator and the throttle operator respectively, the driver of the watercraft can control the amount of reverse thrust being generated.

The reverse thrust being generated when the reverse gate is lowered can also be used to decelerate the watercraft. However, when the watercraft is moving at relatively high speeds, if the driver of the vehicle applies to much reverse thrust, it can cause the stem of the watercraft to lift and the bow of the watercraft to dip. This can result in an undesirably unstable riding condition.

Also, when the watercraft is moving at high speeds, the thrust being generated is also usually high. The high thrust being generated may in some cases prevent the reverse gate from being lowered as the thrust pushes the reverse gate back towards its stowed position when the reverse gate comes in contact with the jet of water being expelled by the jet propulsion system. Therefore, in these cases, in order to decelerate the watercraft, the driver needs to first release the throttle operator in order to reduce the thrust being generated by the jet propulsion system. The driver then needs to actuate the reverse gate operator in order to lower the reverse gate. Finally, the driver needs to actuate the throttle operator sufficiently to generate a reverse thrust, but not too much so as to avoid the above-mentioned problem.

Therefore, there is a need for a way to allow the driver of a watercraft to control the amount of reverse thrust being generated when the reverse gate is lowered while preventing the generation of too much reverse thrust when the watercraft is moving at relatively high speeds.

SUMMARY OF THE INVENTION

It is an object of the present invention to ameliorate at least some of the inconveniences present in the prior art.

It is also an object of the present invention to provide a method of controlling a jet propelled watercraft where the driver controls the amount of reverse thrust being generated below a predetermined speed, but where the amount of reverse thrust being generated above the predetermined speed is at least partially controlled independently of driver inputs.

It is another object of the present invention to provide a watercraft implementing at least an embodiment of the above method.

In one aspect, the invention provides a method of controlling a watercraft. The watercraft has a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull. The reverse gate is movable between a first stowed position and a second position in which the reverse gate redirects a jet of water expelled from the jet propulsion system. The reverse gate is in operative connection with the reverse gate operator. The method comprises actuating the reverse gate operator, sensing a speed of the watercraft, sensing a position of the throttle operator, controlling a thrust generated by the jet propulsion system based at least on the position of the throttle operator when the reverse gate operator is actuated and the speed of the watercraft is below a predetermined watercraft speed, controlling the thrust generated by the jet propulsion system at least in part independently of the position of the throttle operator when the reverse gate operator is actuated and the speed of the watercraft is above the predetermined watercraft speed, and moving the reverse gate to the second position in response to the actuation of the reverse gate operator.

In an additional aspect, when the reverse gate operator is actuated and the speed of the watercraft is above the predetermined watercraft speed, the thrust generated by the jet propulsion system is controlled independently of the position of the throttle operator.

In a further aspect, controlling the thrust generated by the jet propulsion system includes controlling a speed of rotation of the engine.

In an additional aspect, when the reverse gate operator is actuated and the speed of the watercraft is above the predetermined watercraft speed: controlling the speed of rotation of the engine includes controlling the speed of rotation of the engine to be at or below a reverse gate actuation speed in response to the actuation of the lever, the reverse gate is moved to the second position once the speed of rotation of the engine is at or below the reverse gate actuation speed, and once the reverse gate is moved to the second position, controlling the speed of rotation of the engine includes controlling the speed of rotation of the engine in order to decelerate the watercraft.

In a further aspect, controlling a speed of rotation of the engine in order to decelerate the watercraft includes increasing the speed of rotation of the engine above the reverse gate actuation speed.

In an additional aspect, controlling the speed of rotation of the engine comprises adjusting a position of a throttle valve of the engine.

In a further aspect, controlling the speed of rotation of the engine comprises adjusting at least one of an ignition timing and an injection timing of the engine.

In an additional aspect, the method also comprises sensing an actuated position of the reverse gate operator. When the reverse gate operator is actuated and the speed of the watercraft is below the predetermined watercraft speed, moving the reverse gate to the second position includes adjusting the second position of the reverse gate based at least on the actuated position of the reverse gate operator.

In a further aspect, when the reverse gate operator is actuated and the speed of the watercraft is above the predetermined watercraft speed, moving the reverse gate to the second position includes adjusting the second position of the reverse gate independently of an actuated position of the reverse gate operator.

In an additional aspect, the method also comprises adjusting a position of a throttle valve of the engine based on the position of the throttle operator when the reverse gate operator is not actuated.

In a further aspect, the method also comprises sensing an actuated position of the reverse gate operator, and controlling the thrust generated by the jet propulsion system at least in part independently of the position of the throttle operator when the reverse gate operator is actuated and the speed of the watercraft is above the predetermined watercraft speed includes controlling the thrust generated by the jet propulsion system based at least on the speed of the watercraft and the position of the reverse gate operator.

In an additional aspect, when the reverse gate operator is actuated and the speed of the watercraft is above the predetermined watercraft speed, the second position of the reverse gate is a predetermined position independent of the position of the reverse gate operator.

In a further aspect, the method also comprises sensing an actuated position of the reverse gate operator; and controlling the thrust generated by the jet propulsion system at least in part independently of the position of the throttle operator when the reverse gate operator is actuated and the speed of the watercraft is above the predetermined watercraft speed includes adjusting the thrust generated by the jet propulsion system based on changes in the position of the reverse gate operator.

In an additional aspect, the method also comprises returning the reverse gate operator to a non-actuated position; and moving the reverse gate to a neutral position in response to the reverse gate operator returning to the non-actuated position.

In a further aspect, controlling the thrust generated by the jet propulsion system at least in part independently of the position of the throttle operator when the reverse gate operator is actuated and the speed of the watercraft is above the predetermined watercraft speed includes controlling the thrust generated by the jet propulsion system at least in part independently of the position of the throttle operator when the reverse gate operator is actuated and the speed of the watercraft is above the predetermined watercraft speed until the speed of the watercraft is less than or equal to an other predetermined watercraft speed. The other predetermined watercraft speed is less than the predetermined watercraft speed. The method also comprises moving the reverse gate to a neutral position when the speed of the watercraft is less than or equal to the other predetermined watercraft speed.

In another aspect, the invention provides a watercraft having a hull, a deck disposed on the hull, an engine compartment defined between the hull and the deck, an engine disposed in the engine compartment, a throttle body having a throttle valve and being in fluid communication with the engine, a jet propulsion system connected to the hull and operatively connected to the engine, an electronic control unit (ECU) associated with the watercraft for controlling at least an operation of the engine, a throttle operator being movable between an idle position and an actuated position, a throttle operator position sensor associated with the throttle operator for sensing a position of the throttle operator, the throttle operator position sensor being in electronic communication with the ECU, a throttle valve actuator operatively connected to the throttle valve and in electronic communication with the ECU, an engine speed sensor for sensing a speed of rotation of the engine and being in electronic communication with the ECU, a watercraft speed sensor for sensing a speed of the watercraft and being in electronic communication with the ECU, a reverse gate operatively connected to the hull, the reverse gate being movable between a first stowed position and a second position in which the reverse gate redirects a jet of water expelled from the jet propulsion system, a reverse gate actuator operatively connected to the reverse gate for moving the reverse gate between the first stowed position and the second position, and being in electronic communication with the ECU, and a reverse gate operator associated with the watercraft and being in electronic communication with the ECU for controlling the reverse gate actuator. The ECU causes the reverse gate actuator to move the reverse gate to the second position when the reverse gate operator is actuated. The ECU sends a first signal to the throttle valve actuator to control the throttle valve actuator when the reverse gate operator is actuated and the speed of the watercraft is below a predetermined watercraft speed. The first signal is based at least on the position of the throttle operator. The ECU sends a second signal to the throttle valve actuator to control the throttle valve actuator when the reverse gate operator is actuated and the speed of the watercraft is above the predetermined watercraft speed. The second signal is independent at least in part of the position of the throttle operator.

In a further aspect, the second signal is independent of the position of the throttle operator.

In an additional aspect, the second signal controls the throttle valve actuator such that the speed of rotation of the engine is controlled to be at or below a reverse gate actuation speed. When the second signal is sent to the throttle valve actuator, the ECU causes the reverse gate actuator to move the reverse gate to the second position once the speed of rotation of the engine is at or below the reverse gate actuation speed. Once the reverse gate is moved to the second position, the second signal controls the throttle valve actuator such that the watercraft decelerates in a controlled deceleration.

In a further aspect, once the reverse gate is moved to the second position, the second signal controls the throttle valve actuator such that the speed of rotation of the engine is increased above the reverse gate actuation speed.

In an additional aspect, a reverse gate operator position sensor is associated with the reverse gate operator for sensing a position of the reverse gate operator. The reverse gate operator position sensor is in electronic communication with the ECU. When the first signal is sent to the throttle valve actuator, the ECU causes the reverse gate actuator to move the reverse gate to the second position based at least on the position of the reverse gate operator.

In a further aspect, when the second signal is sent to the throttle valve actuator, the ECU causes the reverse gate actuator to move the reverse gate to the second position independently of the position of the reverse gate operator.

In an additional aspect, the ECU sends a third signal to the throttle valve actuator to control the throttle valve actuator when the reverse gate operator is not actuated. The third signal is based at least on the position of the throttle operator.

In a further aspect, a reverse gate operator position sensor is associated with the reverse gate operator for sensing a position of the reverse gate operator. The reverse gate operator position sensor is in electronic communication with the ECU. The second signal is based at least on the speed of the watercraft and the position of the reverse gate operator.

In an additional aspect, a handlebar is operatively connected to the deck. The throttle operator is disposed on the handlebar. The throttle operator is selected from a group consisting of a thumb-actuated throttle lever, a finger-actuated throttle lever, and a twist grip.

In a further aspect, the reverse gate actuator is an electric actuator.

In an additional aspect, when the reverse gate operator is actuated and the speed of the watercraft is above the predetermined watercraft speed, the second position of the reverse gate is a predetermined position independent of the position of the reverse gate operator.

In a further aspect, a reverse gate operator position sensor is associated with the reverse gate operator for sensing a position of the reverse gate operator. The reverse gate operator position sensor is in electronic communication with the ECU. The second signal is based on changes in the position of the reverse gate operator.

In an additional aspect, the ECU causes the reverse gate actuator to move the reverse gate to a neutral position when the reverse gate actuator is returned to a non-actuated position from an actuated position.

In a further aspect, the ECU stops sending the second signal when the speed of the watercraft becomes less than or equal to an other predetermined watercraft speed. The other predetermined watercraft speed is less than the predetermined watercraft speed. The ECU causes the reverse gate actuator to move the reverse gate to a neutral position when the ECU stops sending the second signal.

In another aspect, the invention provides a method of controlling a watercraft. The watercraft has a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull. The reverse gate is movable between a first stowed position and a second position in which the reverse gate redirects a jet of water expelled from the jet propulsion system. The reverse gate is in operative connection with the reverse gate operator. The method comprises: actuating the reverse gate operator; sensing a speed of the watercraft; sensing a position of the throttle operator; moving the reverse gate to the second position in response to the actuation of the reverse gate operator; controlling a thrust generated by the jet propulsion system to be less than or equal to a first predetermined maximum thrust when the reverse gate operator is actuated and the speed of the watercraft is below a predetermined watercraft speed; and controlling the thrust generated by the jet propulsion system to be less than or equal to a second predetermined maximum thrust when the reverse gate operator is actuated and the speed of the watercraft is above the predetermined watercraft speed. The second predetermined maximum thrust is less than the first predetermined maximum thrust.

In a further aspect, the second predetermined maximum thrust increases as the speed of the watercraft decreases.

In an additional aspect, controlling the thrust generated by the jet propulsion system includes controlling a speed of rotation of the engine.

In a further aspect, when the reverse gate operator is actuated and the speed of the watercraft is above the predetermined watercraft speed: controlling the speed of rotation of the engine includes controlling the speed of rotation of the engine to be at or below a reverse gate actuation speed in response to the actuation of the lever; the reverse gate is moved to the second position once the speed of rotation of the engine is at or below the reverse gate actuation speed; and once the reverse gate is moved to the second position, controlling the speed of rotation of the engine includes controlling the speed of rotation of the engine in order to decelerate the watercraft.

In yet another aspect, the invention provides a watercraft comprising a hull, a deck disposed on the hull, an engine compartment defined between the hull and the deck, an engine disposed in the engine compartment, a throttle body having a throttle valve and being in fluid communication with the engine, a jet propulsion system connected to the hull and operatively connected to the engine, an electronic control unit (ECU) associated with the watercraft for controlling at least an operation of the engine, a throttle operator being movable between an idle position and an actuated position, a throttle operator position sensor associated with the throttle operator for sensing a position of the throttle operator, the throttle operator position sensor being in electronic communication with the ECU, a throttle valve actuator operatively connected to the throttle valve and in electronic communication with the ECU, an engine speed sensor for sensing a speed of rotation of the engine and being in electronic communication with the ECU, a watercraft speed sensor for sensing a speed of the watercraft and being in electronic communication with the ECU, a reverse gate operatively connected to the hull, the reverse gate being movable between a first stowed position and a second position in which the reverse gate redirects a jet of water expelled from the jet propulsion system, a reverse gate actuator operatively connected to the reverse gate for moving the reverse gate between the first stowed position and the second position, and being in electronic communication with the ECU, and a reverse gate operator associated with the watercraft and being in electronic communication with the ECU for controlling the reverse gate actuator. The ECU causes the reverse gate actuator to move the reverse gate to the second position when the reverse gate operator is actuated. The ECU sends a first signal to the throttle valve actuator to control the throttle valve actuator when the reverse gate operator is actuated and the speed of the watercraft is below a predetermined watercraft speed. A thrust generated by the jet propulsion system as a result of the first signal being sent to the throttle valve actuator is less than or equal to a first predetermined maximum thrust. The ECU sends a second signal to the throttle valve actuator to control the throttle valve actuator when the reverse gate operator is actuated and the speed of the watercraft is above the predetermined watercraft speed. The thrust generated by the jet propulsion system as a result of the second signal being sent to the throttle valve actuator is less than or equal to a second predetermined maximum thrust. The second predetermined maximum thrust is less than the first predetermined maximum thrust.

In an additional aspect, the second predetermined maximum thrust increases as the speed of the watercraft decreases.

In a further aspect, the second signal controls the throttle valve actuator such that the speed of rotation of the engine is controlled to be at or below a reverse gate actuation speed. When the second signal is sent to the throttle valve actuator, the ECU causes the reverse gate actuator to move the reverse gate to the second position once the speed of rotation of the engine is at or below the reverse gate actuation speed. Once the reverse gate is moved to the second position, the second signal controls the throttle valve actuator such that the watercraft decelerates in a controlled deceleration.

In another aspect, the invention provides a method of controlling a watercraft. The watercraft has a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull. The reverse gate is movable between a first stowed position, a second position in which the reverse gate redirects a jet of water expelled from the jet propulsion system, and a neutral position intermediate the first stowed position and the second position. The reverse gate is in operative connection with the reverse gate operator. The method comprises: a) actuating the reverse gate operator; b) sensing a speed of the watercraft; c) controlling the thrust generated by the jet propulsion system in a reverse mode when the reverse gate operator is actuated and the speed of the watercraft is below a predetermined watercraft speed; d) controlling the thrust generated by the jet propulsion system in a controlled deceleration mode when the reverse gate operator is actuated and the speed of the watercraft is above the predetermined watercraft speed; e) moving the reverse gate to the second position in response to the actuation of the reverse gate operator; f) returning the reverse gate operator to a non-actuated position after the actuation of the reverse gate operator; and g) moving the reverse gate to the neutral position in response to the reverse gate operator returning to the non-actuated position.

In an additional aspect, steps c, d, and e are only carried out if the reverse gate operator has been actuated for a predetermined amount of time.

For purposes of this application, the terms "controlled deceleration" mean a gradual reduction in speed compared to an uncontrolled deceleration which may result in an abrupt reduction in speed which could cause the driver of the watercraft to lose control of the watercraft.

Embodiments of the present invention each have at least one of the above-mentioned objects and/or aspects, but do not necessarily have all of them. It should be understood that some aspect of the present invention that have resulted from attempting to attain the above-mentioned objects may not satisfy these objects and/or may satisfy other objects not specifically recited herein.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The general construction of a personal watercraft 10 in accordance with this invention is shown in FIGS. 1-5. The following description relates to one way of manufacturing a personal watercraft. Obviously, those of ordinary skill in the watercraft art will recognize that there are other known ways of manufacturing and designing watercraft and that this invention would encompass these other known ways and designs.

Figure 1:
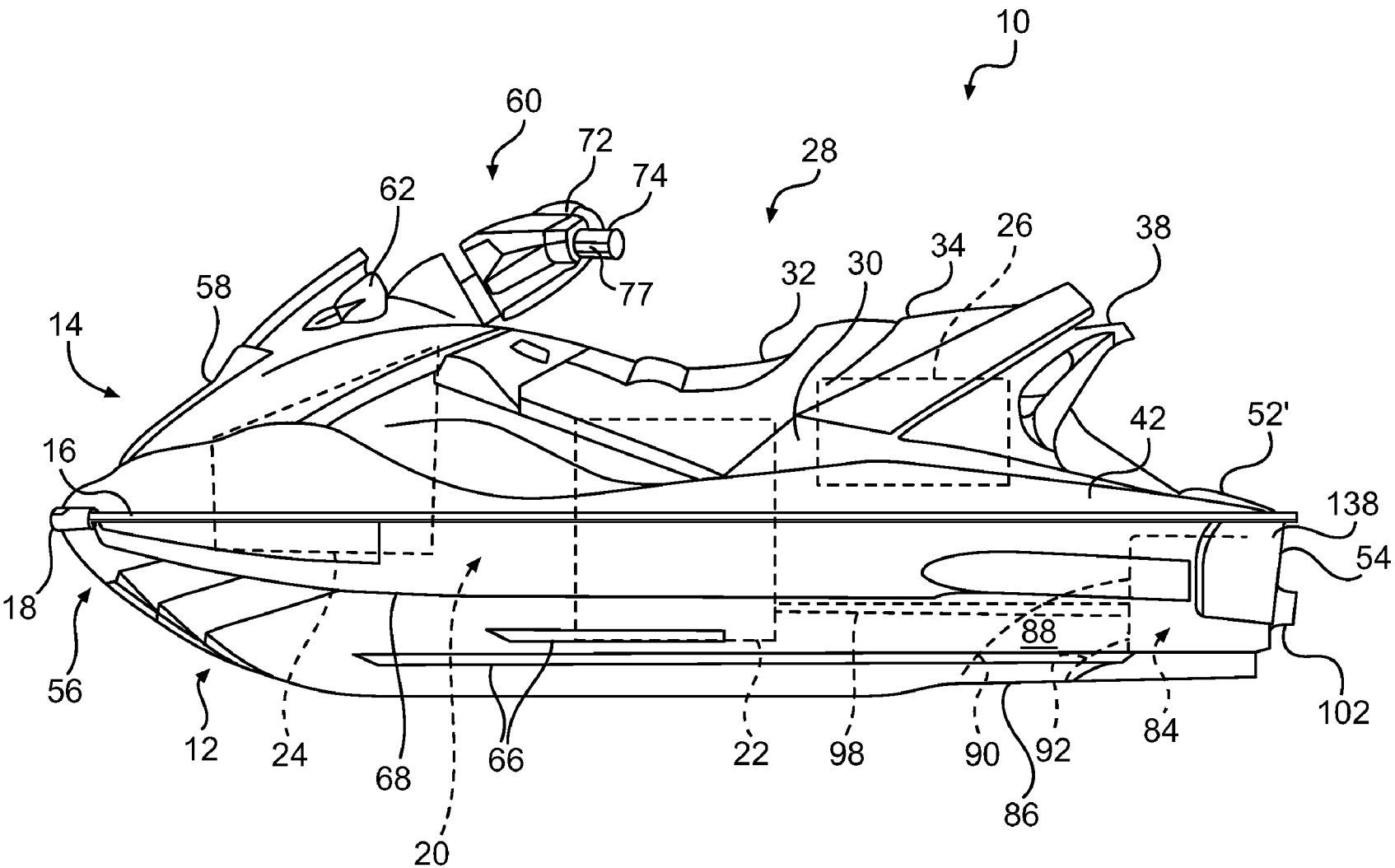
FIG. 1 illustrates a side view of a personal watercraft in accordance with the invention.

The watercraft 10 of FIG. 1 is made of a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). The engine compartment 20 accommodates an engine 22, as well as a muffler, tuning pipe, gas tank, electrical system (battery, electronic control unit, etc.), air box, storage bins 24, 26, and other elements required or desirable in the watercraft 10.

Figure 2:
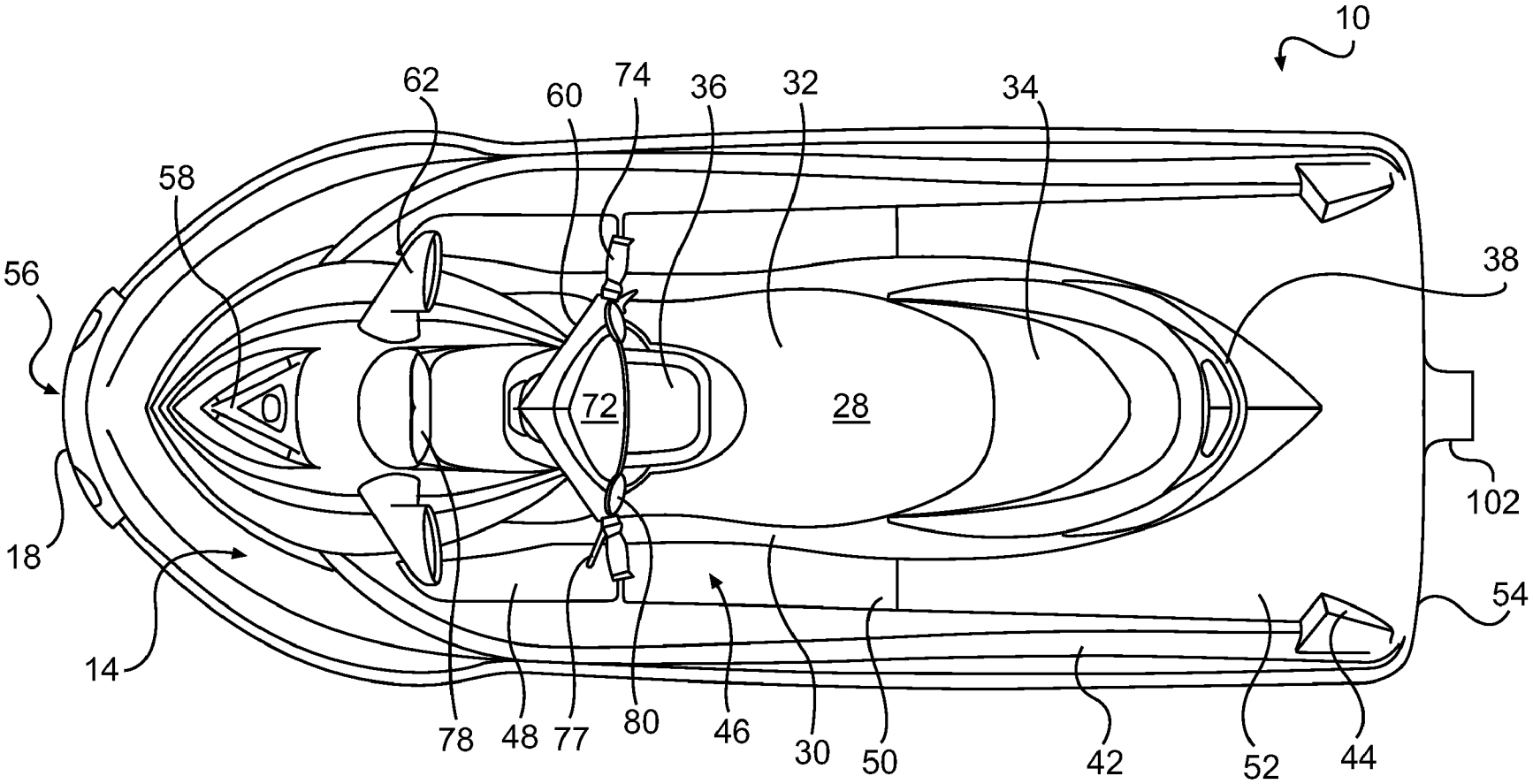
FIG. 2 is a top view of the watercraft of FIG. 1.

As seen in FIGS. 1 and 2, the deck 14 has a centrally positioned straddle-type seat 28 positioned on top of a pedestal 30 to accommodate multiple riders in a straddling position. As seen in FIG. 2, the seat 28 includes a first, front seat portion 32 and a rear, raised seat portion 34. The seat 28 is preferably made as a cushioned or padded unit, or as interfitting units. The first and second seat portions 32, 34 are removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. Seat portion 32 covers an engine access opening defined by a top portion of the pedestal 30 to provide access to the engine 22 (FIG. 1). Seat portion 34 covers a removable storage box 26 (FIG. 1). A "glove compartment" or small storage box 36 is provided in front of the seat 28.

Figure 4:
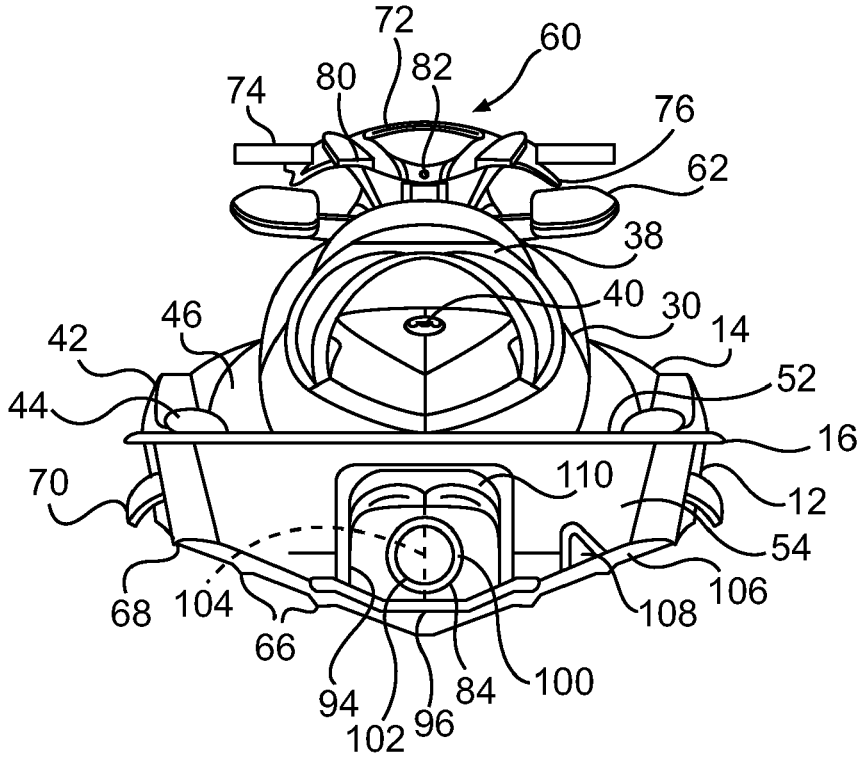
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4, the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. A passenger riding the watercraft 10 facing towards the rear, to spot a water-skier for example, may place his or her heels on the heel rests 44, thereby providing a more stable riding position. Heel rests 44 could also be formed separately from the gunnels 42.

Located on both sides of the watercraft 10, between the pedestal 30 and the gunnels 42 are the footrests 46. The footrests 46 are designed to accommodate the riders' feet in various riding positions. To this effect, the footrests 46 each have a forward portion 48 angled such that the front portion of the forward portion 48 (toward the bow of the watercraft 10) is higher than the rear portion of the forward portion 48. The remaining portions of the footrests 46 are generally horizontal. Of course, any contour conducive to a comfortable rest for the riders could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
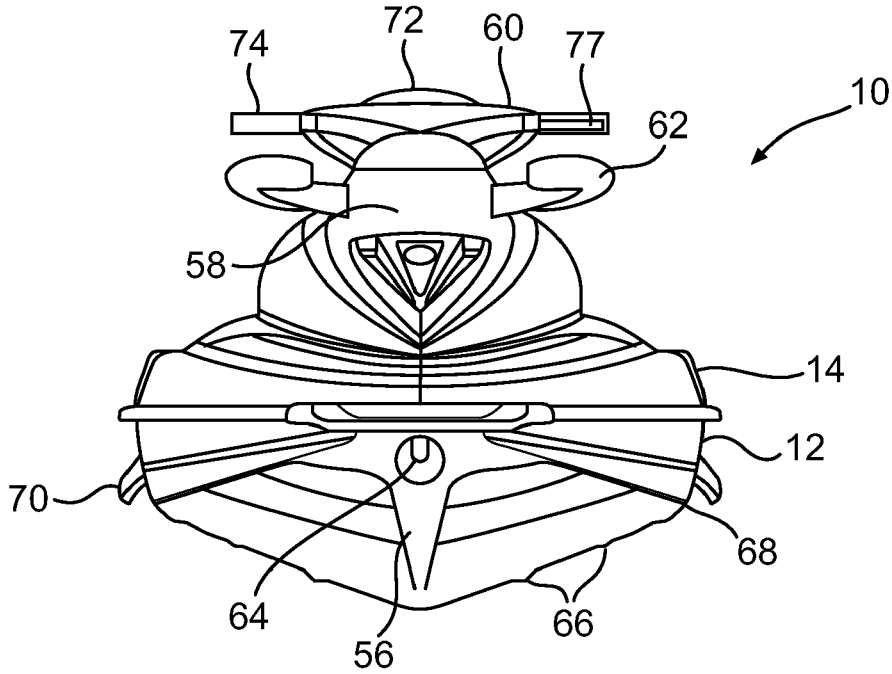
FIG. 3 is a front view of the watercraft of FIG. 1.

Referring to the bow 56 of the watercraft 10, as seen in FIGS. 2 and 3, the watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft 10 is not in use or to attach to a winch when loading the watercraft 10 on a trailer, for instance.

Figure 5:
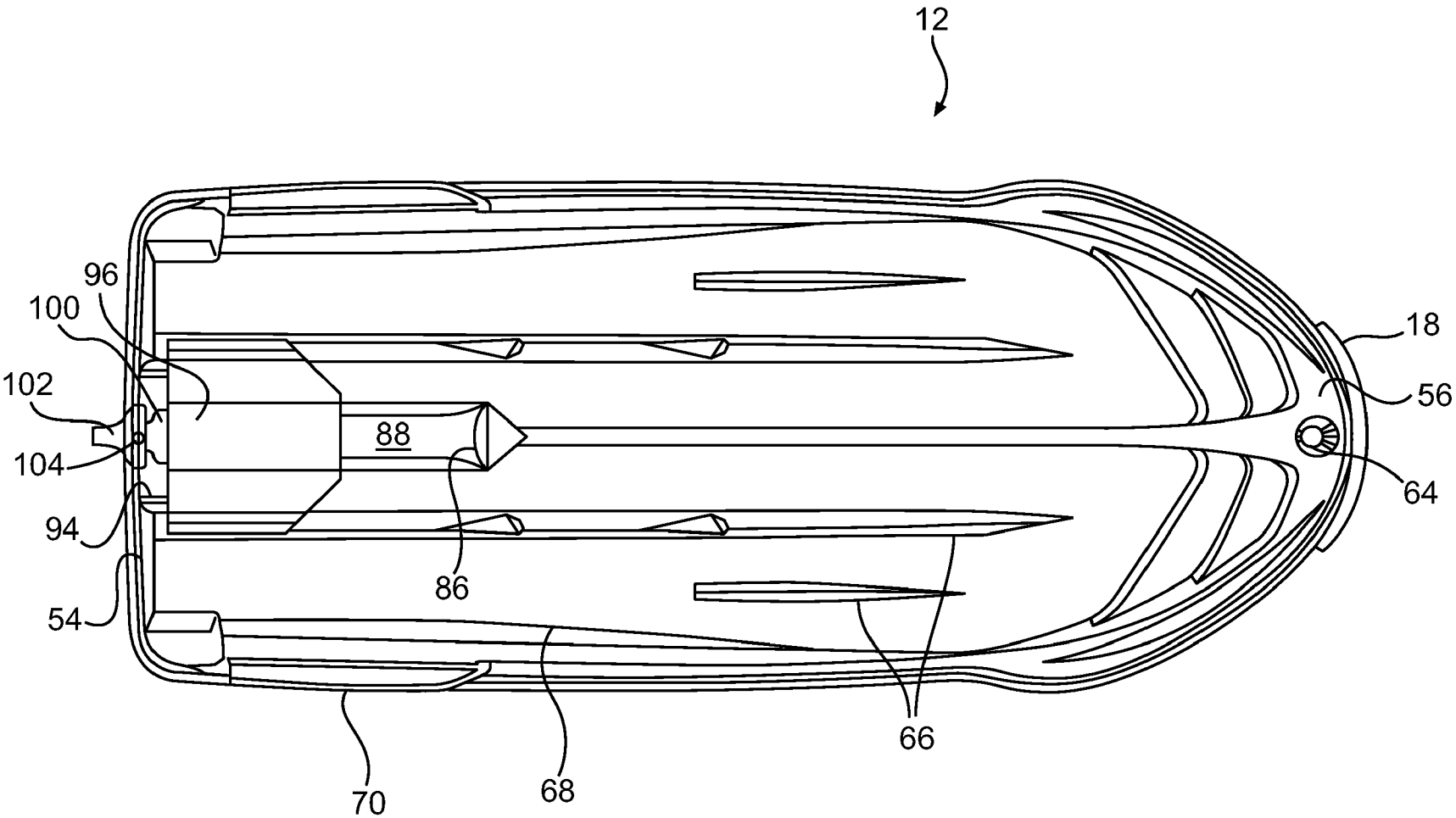
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 with respect to the hull 12 may be adjustable to change the handling characteristics of the watercraft 10 and accommodate different riding conditions. Trim tabs, which are commonly known, may also be provided at the transom and may be controlled from the helm 60.

As best seen in FIGS. 3 and 4, the helm assembly 60 is positioned forwardly of the seat 28. The helm assembly 60 has a central helm portion 72, that is padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. In a preferred embodiment, the throttle operator 76 is biased towards the idle position, such that, should the driver of the watercraft 10 let go of the throttle operator 76, it will move to the idle position. The other of the steering handles 74 is provided with a reverse gate operator 77 used by the driver to actuate a reverse gate 110 of the watercraft 10 as described in greater detail below. The reverse gate operator 77 is a finger-actuated lever. However, it is contemplated that the reverse gate operator 77 could be a thumb-actuated lever or a twist grip.

As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 has various buttons 80, which could alternatively be in the form of levers or switches, that allow the driver to modify the display data or mode (speed, engine rpm, time . . . ) on the display cluster 78 or to change a condition of the watercraft 10, such as trim (the pitch of the watercraft 10).

The helm assembly 60 is provided with a key receiving post 82 located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. As is known, the jet propulsion system 84 pressurizes water to create thrust. The water is first scooped from under the hull 12 through an inlet 86, which has an inlet grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters a jet pump (not shown). The jet pump is located in a formation in the hull 12, referred to as the tunnel 94. The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet pump includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Moreover, the steering nozzle 102 can be replaced by a rudder or other diverting mechanism disposed at the exit of the tunnel 94 to selectively direct the thrust generated by the jet propulsion system 84 to effect turning.

Figure 8:
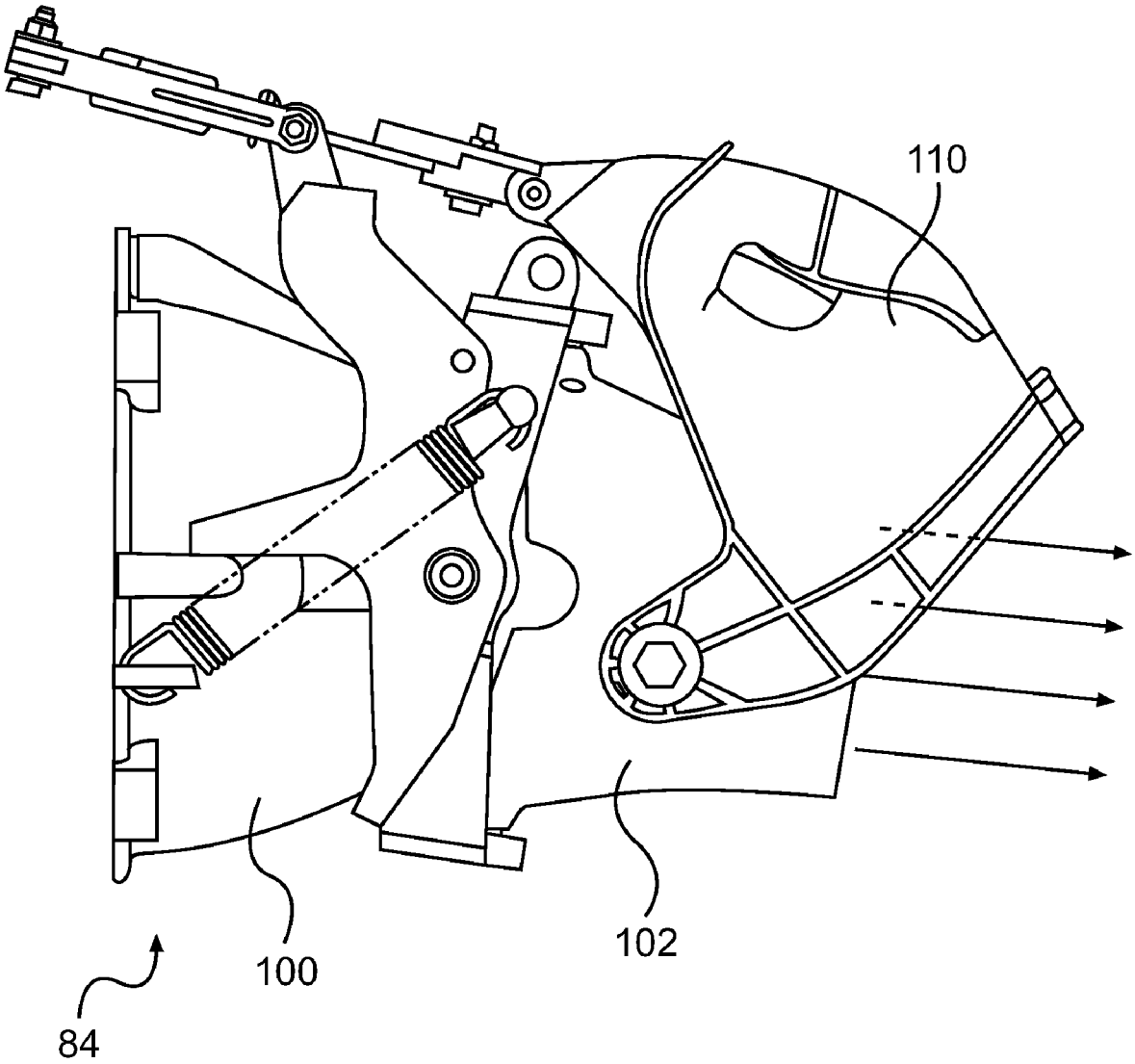
FIG. 8 is a side view of a jet propulsion system nozzle and reverse gate assembly where the reverse gate is mounted on the nozzle assembly with the reverse gate in a stowed position.
Figure 9:
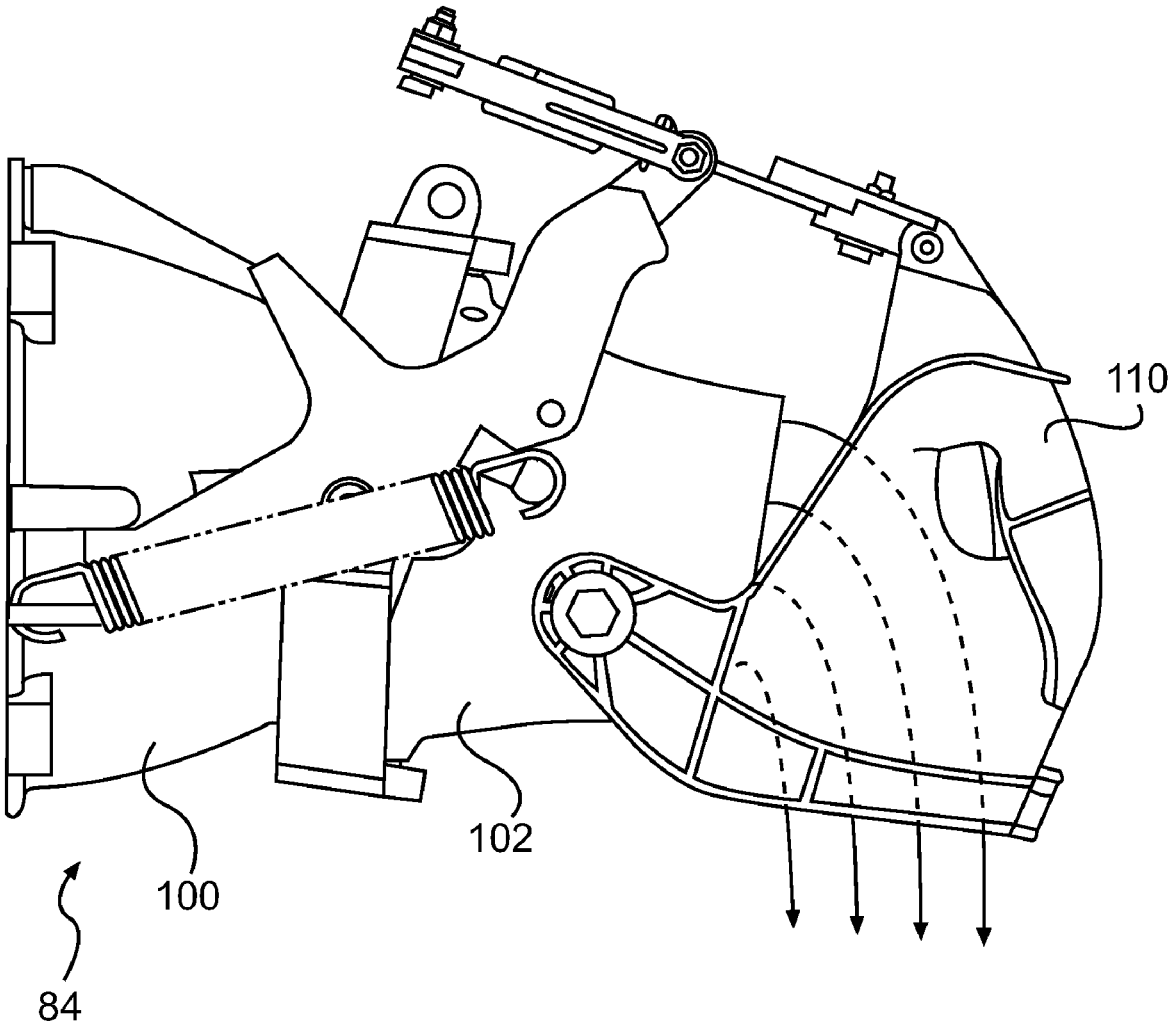
FIG. 9 is a side view of the jet propulsion system nozzle and reverse gate assembly of FIG. 8 with the reverse gate in a neutral position.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi 100, so as to redirect the thrust and steer the watercraft 10 in the desired direction. Optionally, the steering nozzle 102 may be gimbaled to allow it to move around a second horizontal pivot axis (as shown in FIGS. 8 and 9). The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 also turns faster. An electronic control unit (ECU) 200 (FIG. 12) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 10:
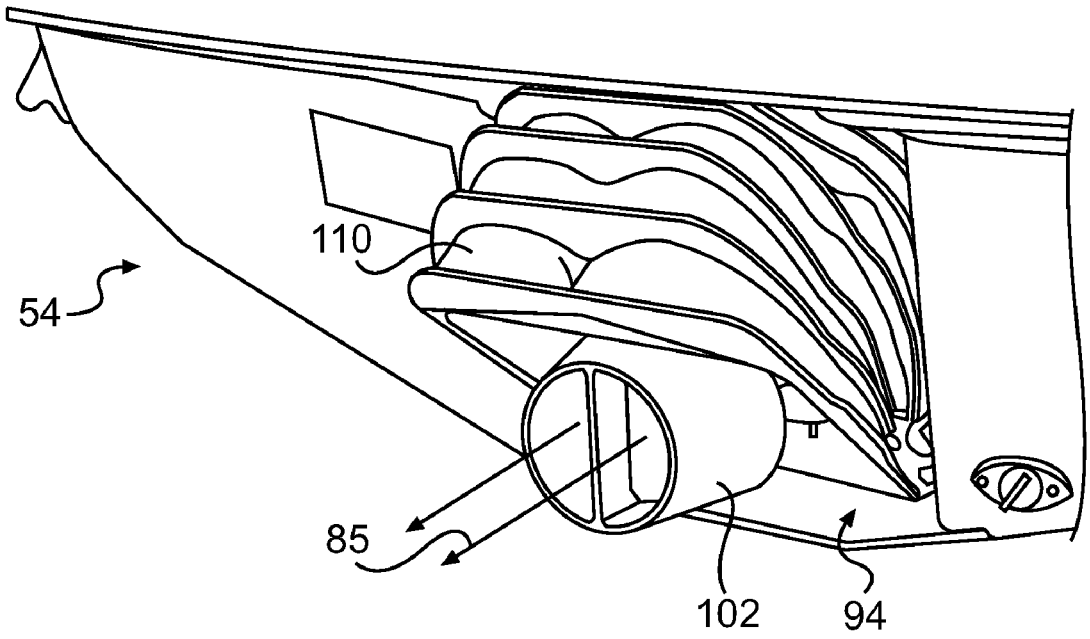
FIG. 10 is a perspective view, taken from a right side, of a transom of a watercraft illustrating a reverse gate mounted to the hull and in a stowed position.
Figure 11:
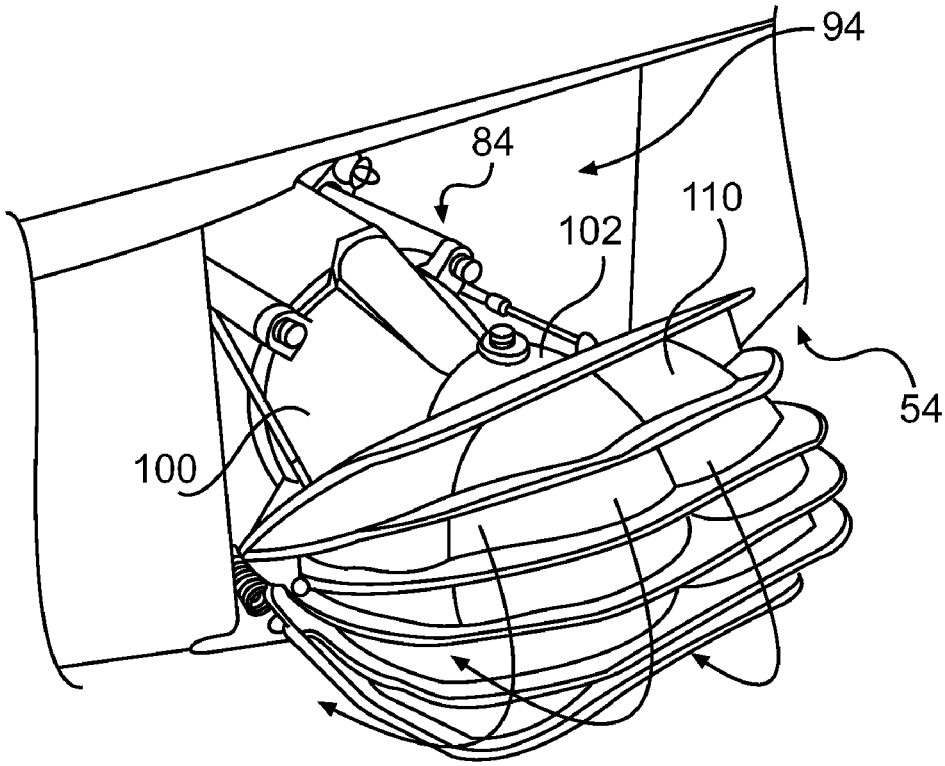
FIG. 11 is a perspective view, taken from a left side, of the transom of FIG. 10 with the reverse gate in a reverse position.

The watercraft 10 is provided with a reverse gate 110 which is movable between a first stowed position where it does not interfere with the jet of water (indicated by arrows 85) being expelled by the jet propulsion system 84 and a plurality of positions where it redirects the jet of water 85 being expelled by the jet propulsion system 84. A reverse gate actuator (not shown) is operatively connected to the reverse gate 110 to move the reverse gate 110. The reverse gate actuator could be any one of a mechanical, a hydraulic, or an electric actuator, such as an electric motor. One contemplated reverse gate actuator is shown and described in U.S. patent application Ser. No. 11/962,396, filed Dec. 21, 2007, the entirety of which is incorporated herein by reference. As seen in FIGS. 8 and 9, it is contemplated that the reverse gate 110 could be mounted directly on the jet propulsion system 84 so as to move with the steering nozzle 102 as it turns and trims. Details of this arrangement can be found in U.S. Pat. No. 6,533,623 B2, issued Mar. 18, 2003, the entirety of which is incorporated herein by reference. In FIG. 8, the reverse gate 110 is in a stowed position. In FIG. 9, the reverse gate 110 is in a neutral position where it redirects the jet of water 85 downwardly. Since the thrust generated by the redirected jet of water 85 when the reverse gate 110 is in the neutral position does not have a horizontal component, the watercraft 10 will not be accelerated or decelerated by the thrust and will stay in position if it was not moving prior to moving the reverse gate 110 in the neutral position. As seen in FIGS. 10 and 11, it is also contemplated that the reverse gate 110 could be pivotally attached to the sidewalls of the tunnel 94. In FIG. 10, the reverse gate 110 is in a stowed position. In FIG. 11, the reverse gate 110 is in a reverse position as it redirects the jet of water 85 towards the front of the watercraft 10, thus causing the watercraft 10 to move in a reverse direction. Other ways of operatively mounting the reverse gate 110 to the hull 12 are also contemplated. The operation of the reverse gate 110 is discussed in greater detail below.

Figure 6:
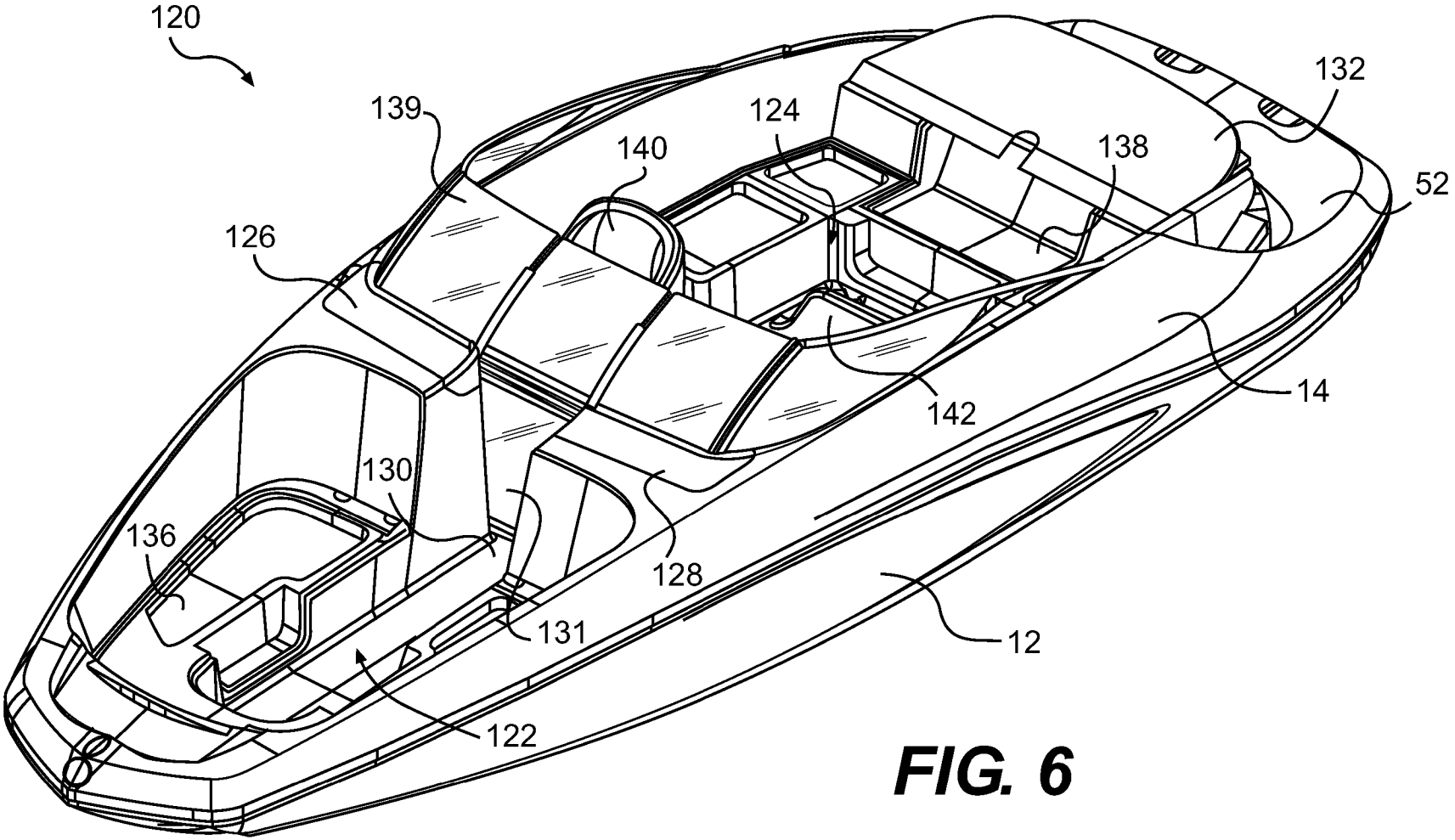
FIG. 6 is a perspective view, taken from a front, left side, of a sport boat in accordance with the invention.
Figure 7:
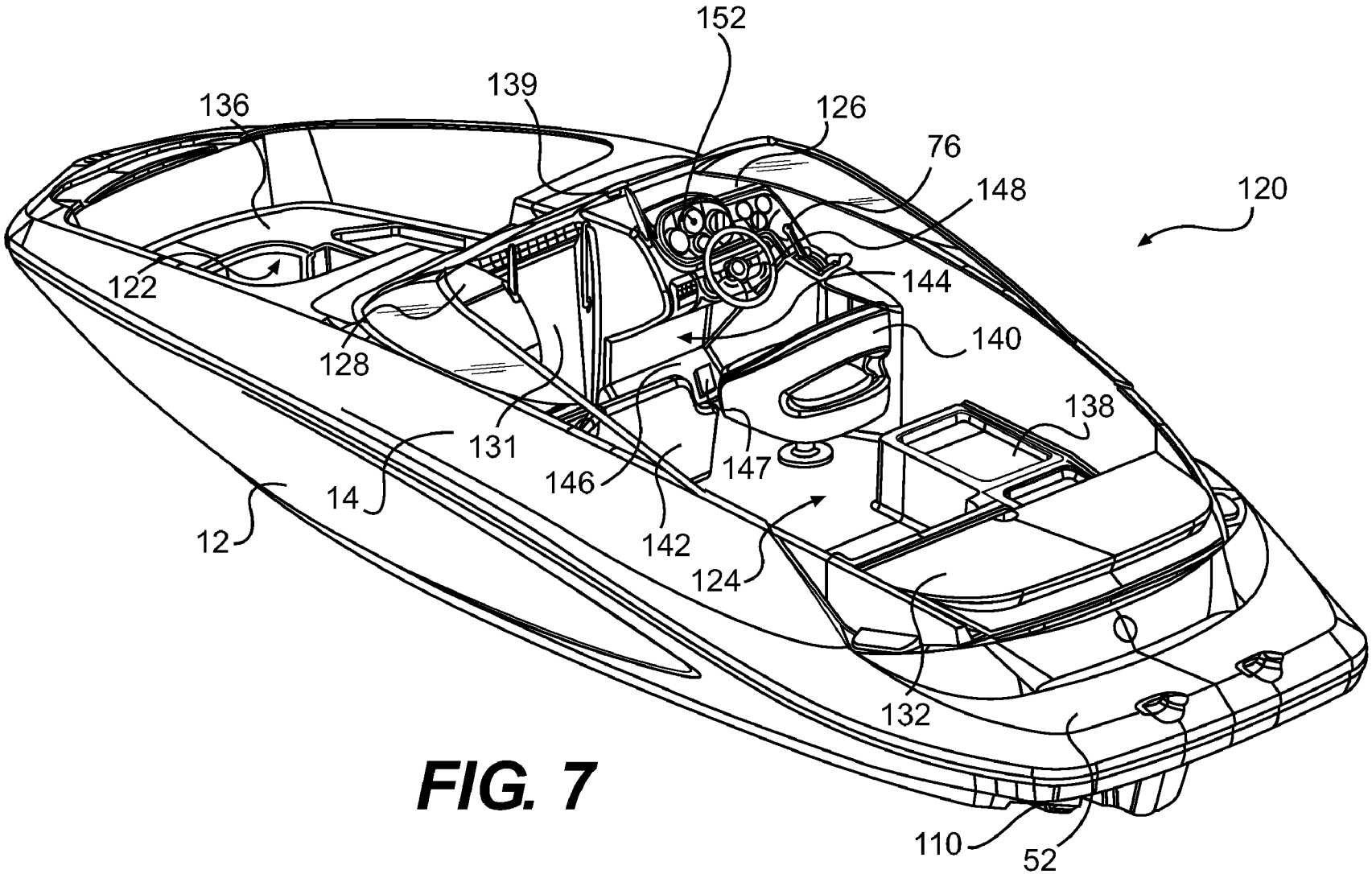
FIG. 7 is a perspective view, taken from a rear, left side, of the sport boat of FIG. 6.

The general construction of a sport boat 120 in accordance with this invention is shown in FIGS. 6 and 7. The following description relates to one way of manufacturing a sport boat. Obviously, those of ordinary skill in the sport boat art will recognize that there are other known ways of manufacturing and designing sport boats and that this invention would encompass these other known ways and designs.

For simplicity, the components of the sport boat 120 which are similar in nature to the components of the personal watercraft 10 described above will be given the same reference numeral. It should be understood that their specific construction may vary however.

The sport boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers the jet propulsion system (not shown) of the boat 120. The jet propulsion system is of similar construction as the jet propulsion system 84 of the personal watercraft 10 described above, and will therefore not be described again. A reverse gate 110 is operatively mounted to the hull 12. The reverse gate 110 is of similar construction as the reverse gate 110 of the personal watercraft 10 described above, and will therefore not be described again. In a preferred embodiment, the boat 120 has two engines and two jet propulsion systems each provided with a reverse gate 110. The engine is accessible through an engine cover 132 located behind the rearward passenger area 124. The engine cover 132 can also be used as a sundeck for a passenger of the boat 120 to sunbathe on while the boat 120 is not in operation. A reboarding platform 52 is located at the back of the deck 14 for passengers to easily reboard the boat 120 from the water.

Figure 13C:
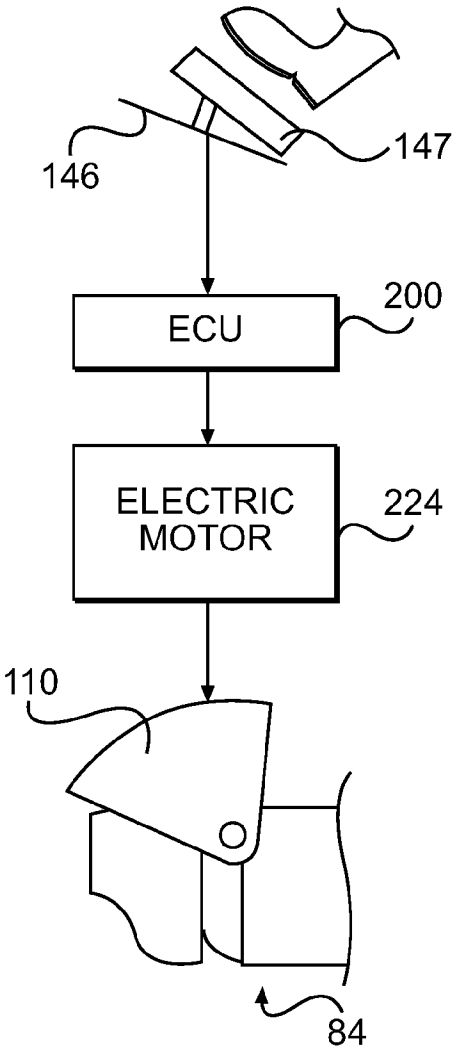
FIG. 13C is a schematic representation of another alternative embodiment of the reverse gate actuation system of FIG. 13A.
Figure 13B:
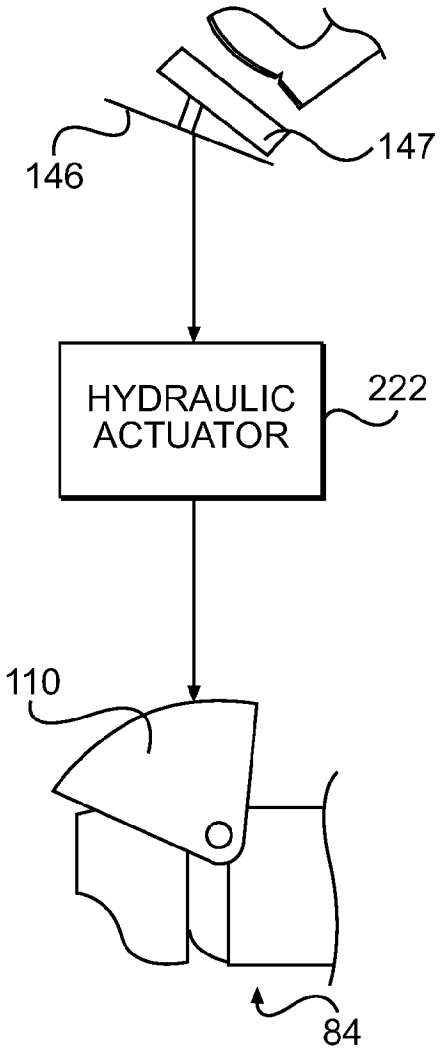
FIG. 13B is a schematic representation of an alternative embodiment of the reverse gate actuation system of FIG. 13A.
Figure 13A:
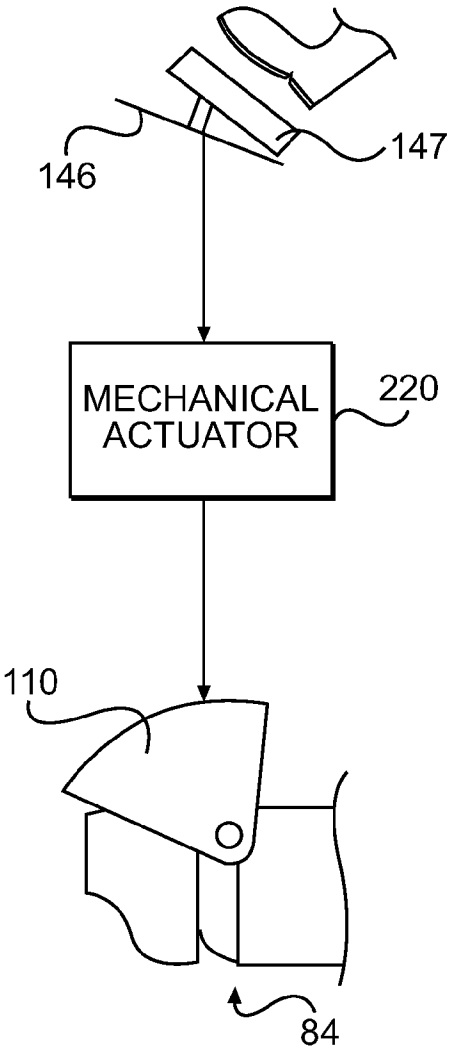
FIG. 13A is a schematic representation of an embodiment of a reverse gate actuation system of the sport boat of FIG. 6.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A reverse gate operator, in the form of a foot pedal 147, is provided on the footrest 146. It is contemplated that the foot pedal 147 could be replaced by a handle positioned near or on the steering wheel 148. The function of the foot pedal 147 is similar to that of the reverse gate operator 77 of the personal watercraft 10. As shown in FIGS. 13A to 13C, the foot pedal 147 is operatively connected to the reverse gate 110. When the foot pedal 147 is not actuated, the reverse gate 110 is in the stowed position. When the foot pedal 147 is actuated, the reverse gate 110 moves to a position in which the jet of water 85 expelled by the jet propulsion system 84 is redirected as explained in greater detail below. FIG. 13A illustrates an embodiment where the foot pedal 147 is operatively connected to the reverse gate 110 via a mechanical actuator 220. FIG. 13B illustrates an embodiment where the foot pedal 147 is operatively connected to the reverse gate 110 via a hydraulic actuator 222. FIG. 13C illustrates an embodiment where the ECU 200 first receives a signal indicative of the position of the foot pedal 147. The ECU 200 then sends a signal to an electric motor 224 to move the reverse gate 110 to a position based on the signal indicative of the position of the foot pedal 147 as described below. The left console 128 has a recess (not shown) similar to recess 144 to accommodate the feet of the passenger sitting in the passenger seat 142. The right console 126 accommodates all of the elements necessary to the driver to operate the boat. These include, but are not limited to, a helm assembly in the form of the steering wheel 148, a throttle operator 76 in the form of a throttle lever, and an instrument panel 152. The instrument panel 152 have various dials indicating the watercraft speed, engine speed, fuel and oil level, and engine temperature. The speed of the boat 120 is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Figure 12:
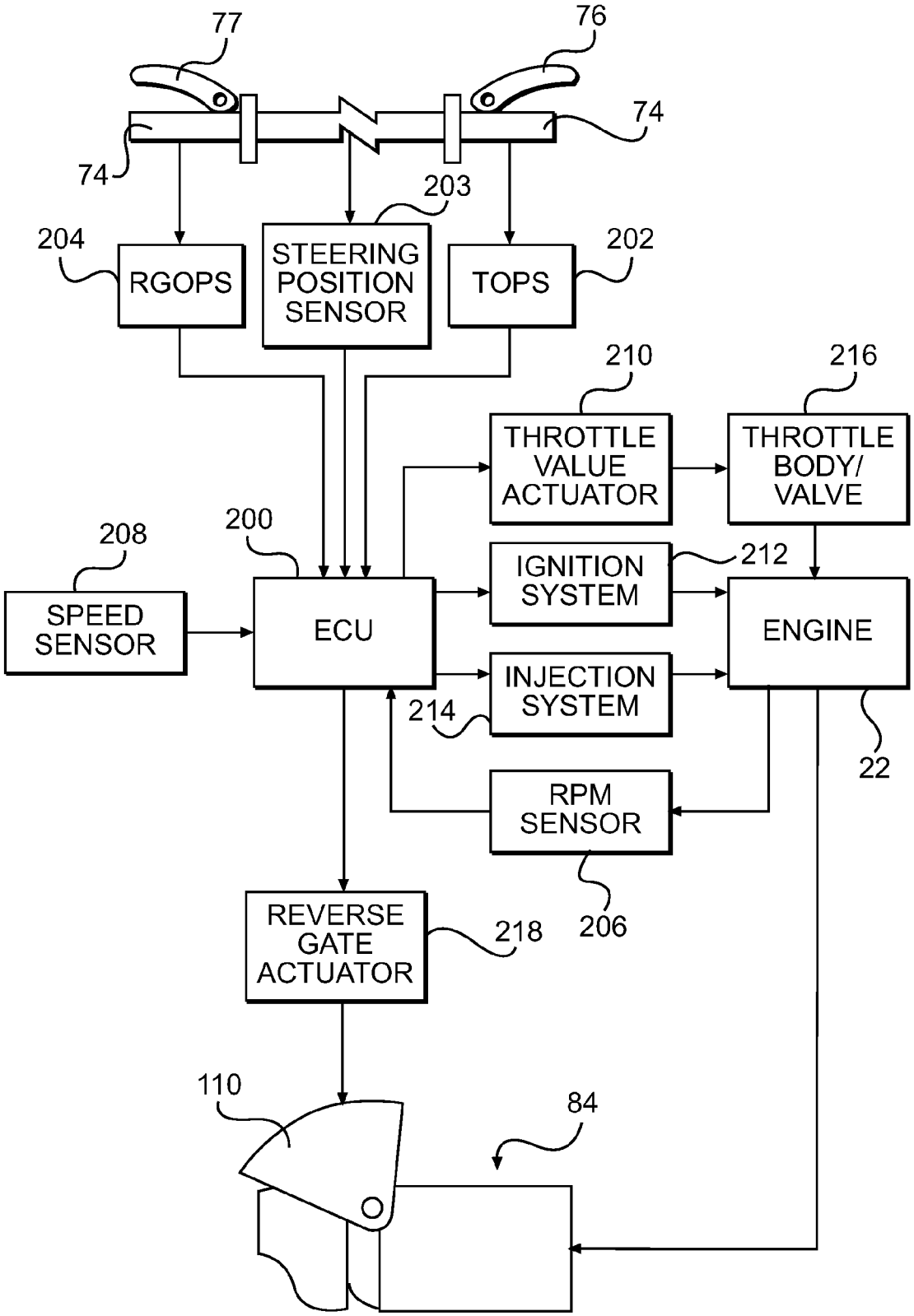
FIG. 12 is a schematic representation of the various sensors and watercraft components that may be present in a watercraft in accordance with the present invention.

Turning now to FIG. 12, additional components of both the personal watercraft 10 and the sport boat 120 will be described. Although FIG. 12 illustrates a throttle operator 76 mounted to the handlebar like in the watercraft 10, it should be understood that a throttle operator 76 of the type used in the sport boat 120 is contemplated. Similarly, although the reverse gate operator 77 is illustrated as being mounted to the handlebar, it is contemplated that a foot pedal, such as the foot pedal 147 of the sport boat 120, could be used. In the personal watercraft 10, the foot pedal could be located in one of the footrests 46.

A throttle operator position sensor 202 senses a position of the throttle operator 76 and sends a signal representative of the throttle operator position to the ECU 200. Depending on the type of throttle operator 76, the throttle operator position sensor 202 is generally disposed in proximity to the throttle operator 76 and senses the movement of the throttle operator 76 or the linear displacement of a cable connected to the throttle operator 76. The throttle operator position sensor 202 is preferably in the form of a magnetic position sensor. In this type of sensor, a magnet is mounted to the throttle operator 76 and a sensor chip is fixedly mounted in proximity to the magnet. As the magnet moves, due to movement of the throttle operator 76, the magnetic field sensed by the sensor chip varies. The sensor chip transmits a voltage corresponding to the sensed magnetic field, which corresponds to the position of the throttle operator 76, to the ECU 200. It is contemplated that the sensor chip could be the one mounted to the throttle operator 76 and that the magnet could be fixedly mounted in proximity to the sensor chip. The throttle operator position sensor 202 could also be in the form of a rheostat. A rheostat is a resistor which regulates current by means of variable resistance. In this case, the position of the throttle operator 76 would determine the resistance in the rheostat which would result in a specific current being transmitted to the ECU 200. Therefore, this current is representative of the position of the throttle operator 76. It is contemplated that other types of sensors could be used as the throttle operator position sensor 202, such as a potentiometer which regulates voltage instead of current.

Similarly, a reverse gate operator position sensor 204 senses a position of the reverse gate operator 77 (or foot pedal 147) and sends a signal representative of the reverse gate operator position to the ECU 200. The reverse gate operator position sensor 204 can be of any of the types of sensors described above with respect to the throttle operator positions sensor 202.

A steering position sensor 203 senses an angle by which the helm assembly is turned and sends a signal representative of that angle to the ECU 200. The steering position sensor 203 can be of any type. Examples of such sensors are described in U.S. Pat. No. 6,428,371, issued Aug. 6, 2002, the entirety of which is incorporated herein by reference.

An engine speed sensor 206 senses a speed of rotation of the engine 22 and sends a signal representative of the speed of rotation of the engine 22 to the ECU 200. Typically, an engine, such as engine 22, has a toothed wheel disposed on and rotating with a shaft of the engine 22, such as the crankshaft or output shaft. The engine speed sensor 206 is located in proximity to the toothed wheel and sends a signal to the ECU 200 each time a tooth passes in front it. The ECU 200 can then determine the engine rotation speed by calculating the time elapsed between each signal. The speed of rotation of the engine 22 can be used by the ECU 200 to calculate the engine torque.

A watercraft speed sensor 208 senses the speed of the watercraft and sends a signal representative of the speed of the watercraft to the ECU 200. The ECU 200 sends a signal to a speed gauge located in the display cluster 78 (FIG. 2) of the personal watercraft 10 or in the instrument panel 152 of the sport boat 120 such that the speed gauge displays the watercraft speed to the driver of the watercraft. The vehicle speed sensor 208 can be of any type, such as the speed sensor 106 or the GPS unit described above.

Depending on the operating condition of the watercraft, one or more of the signals received from the throttle operator position sensor 202, the reverse gate operator position sensor 204, the steering position sensor 203, the engine speed sensor 206, and the watercraft speed sensor 208 can be used by the ECU 200 to control the operation of the engine 22. The ECU 200 controls the operation of the engine 22, and therefore the speed of rotation of the engine 22, by sending signals to a throttle valve actuator 210, an ignition system 212 of the engine 22, and an injection system 214 of the engine 22. The throttle valve actuator 210 is preferably an electric motor, such as a servo motor. The throttle valve actuator 210 is connected to the valve 216 of the throttle body of the engine 22. Based on the signal from the ECU 200, the throttle valve actuator 210 changes a degree of opening of the throttle valve so as to control the flow of air to the engine 22. A throttle valve position sensor (not shown) could be provided to send a feedback signal indicative of the position of the throttle valve 216 to the ECU 200. The signal from the ECU 200 to the ignition system 212 controls the ignition timing. The signal(s) from the ECU 200 to the injection system 214 controls the injection timing and the quantity of fuel being injected per injection event. It is contemplated that the engine 22 may be provided with a carburetor instead of the throttle body and would therefore not require an injection system 214. It is believed that the way in which the degree of opening of the throttle valve 216, the ignition timing, the injection timing, and the quantity of fuel being injected affect the speed of rotation of the engine 22 are well understood by those skilled in the art of engines and will therefore not be described.

As would also be understood by those skilled in the art of jet propelled watercraft, increasing or decreasing the speed of rotation of the engine 22 results in an increase or decrease, respectively, in the thrust generated by the jet propulsion system 84. However, it is contemplated that the thrust generated by the jet propulsion system could otherwise be controlled. For example, the diameter of a portion of the jet propulsion system 84, such as the venturi 110 or steering nozzle 102, could be varied. U.S. Pat. No. 6,857,918, issued Feb. 22, 2005, the entirety of which is incorporated herein by reference, discloses various variable venturies to be used in a jet propulsion system.

The ECU 200 also sends a signal to a reverse gate actuator 218 to move the reverse gate 110 between a stowed position (FIGS. 8 and 10) and a position in which the reverse gate 110 redirects the jet of water 85 expelled from the jet propulsion system 84 (FIGS. 9 and 11), as will be described in greater detail below. The reverse gate actuator 218 can be in the form of an electric actuator, an hydraulic actuator, or any other type of actuator suitable for moving the reverse gate 110 and maintaining it in position.

Figure 14:
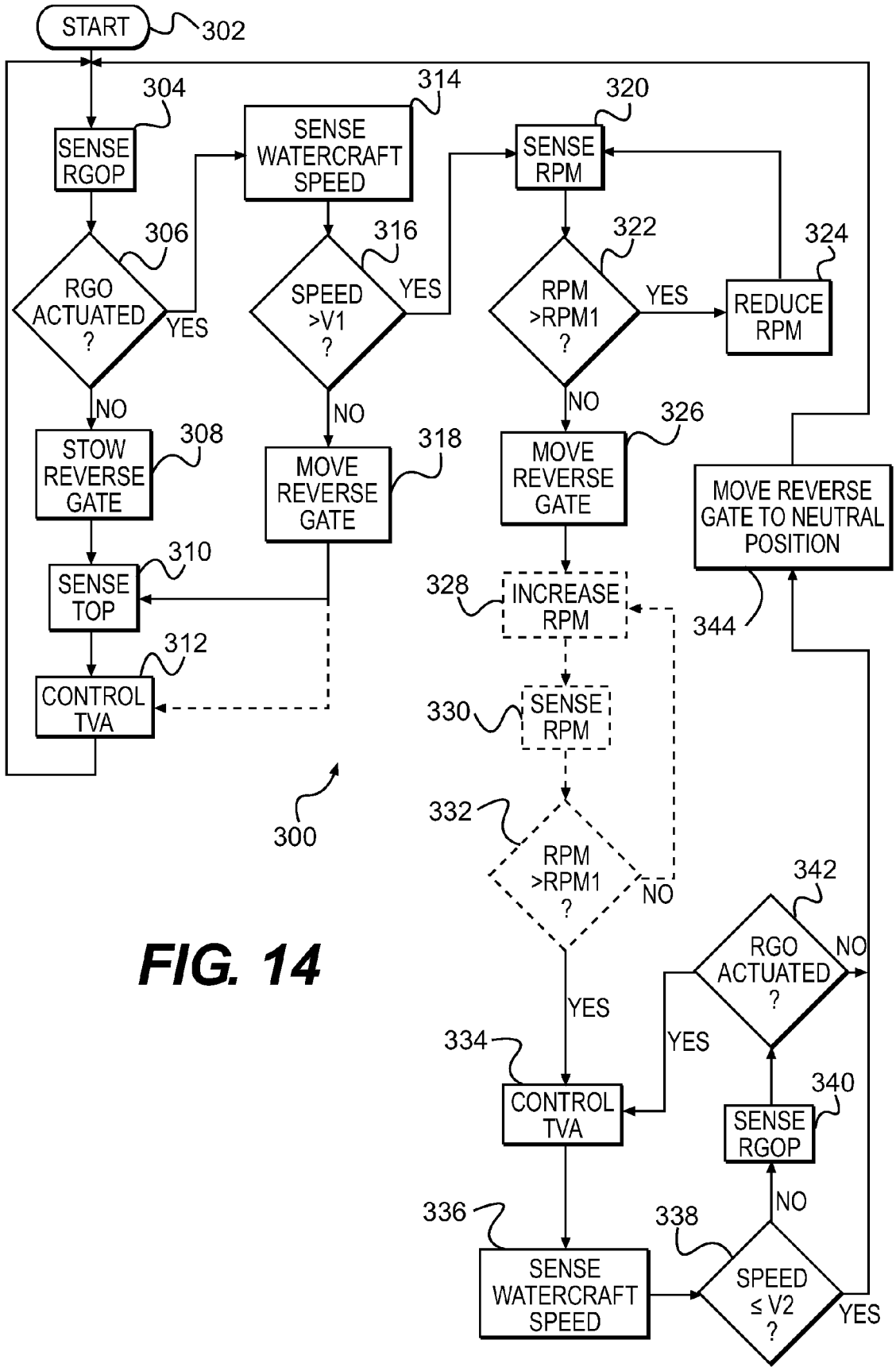
FIG. 14 is a logic diagram illustrating a method of controlling a watercraft in accordance with the present invention.
Figure 15:
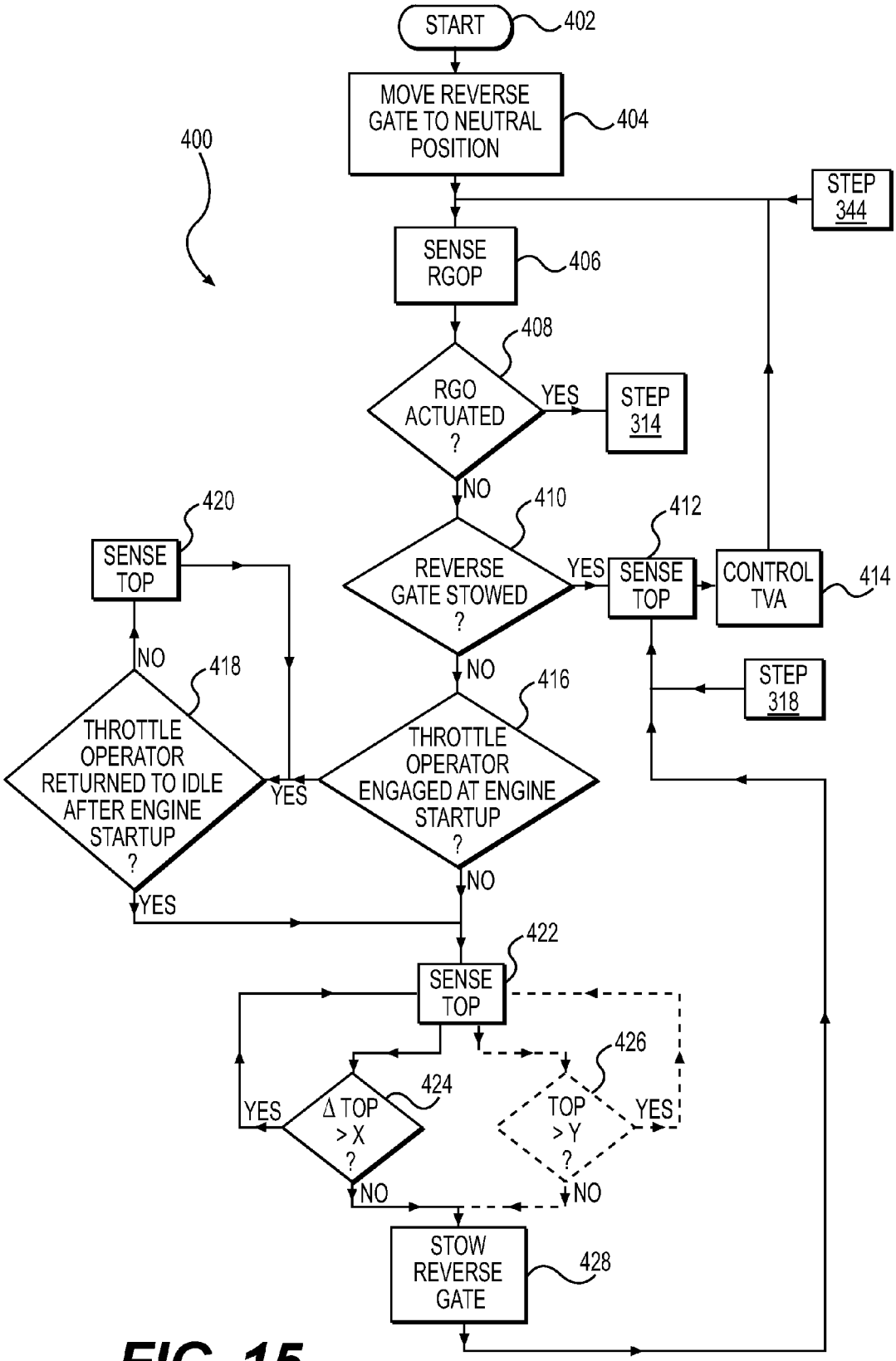
FIG. 15 is a logic diagram illustrating a portion of an alternative method of controlling a watercraft in accordance with the present invention.
Figure 16:
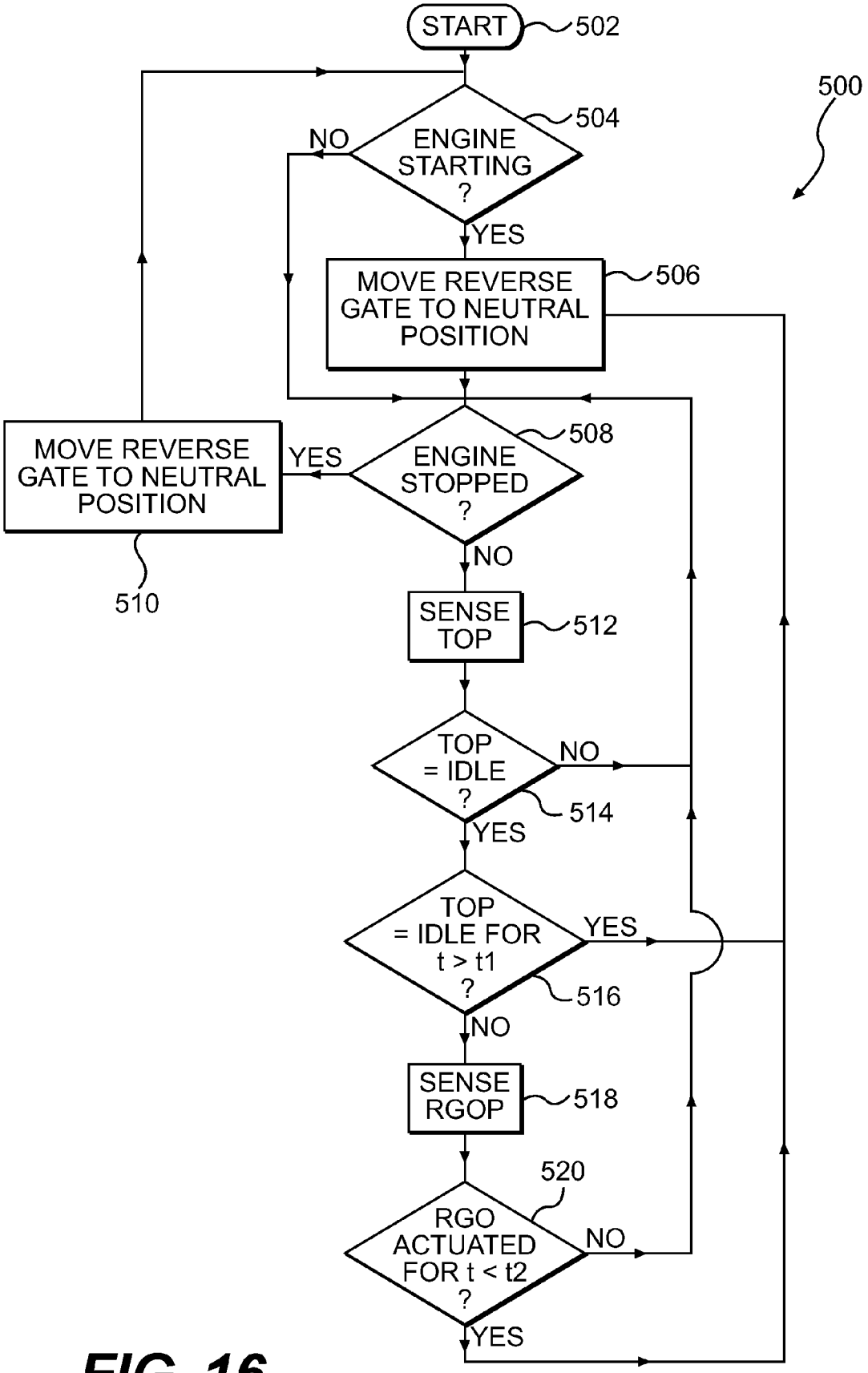
FIG. 16 is a logic diagram illustrating another method of controlling a watercraft.

Turning now to FIGS. 14 to 16, methods of controlling a watercraft, methods 300, 400, and 500 respectively, will be described. For simplicity, the methods 300, 400, and 500 will be explained with respect to the personal watercraft 10, but it should be understood that the same or similar methods could be used with the sport boat 120. Many of the steps of the methods 300, 400, and 500 described below involve the ECU 200. It is contemplated that electronic modules other than the ECU 200 could be involved in these steps instead of the ECU 200. However, for purposes of this application, these other electronic modules would be considered to be part of the ECU 200. Also, in the embodiments described below, the thrust generated by the jet propulsion unit 84 is controlled by controlling a speed of rotation of the engine 22, but it is contemplated that the thrust generated could be controlled otherwise, as previously mentioned. Finally, in the embodiments described below, the speed of rotation of the engine 22 is controlled by moving the throttle valve 216 by having the ECU 200 send a signal to the throttle valve actuator 210. However it is contemplated that the speed of rotation of the engine 22 could be controlled by having the ECU 200 send a signal to the ignition system 212 and/or the injection system 214 alone or in combination with the signal sent to the throttle valve actuator 210.

Turning now to FIG. 14, the method 300 is initiated at step 302. Then at step 304, the reverse gate operator position sensor 204 senses the position of the reverse gate operator 77 and sends a signal representative of this position to the ECU 200. At step 306, the ECU 200 determines if the reverse gate operator 77 is actuated.

If at step 306 it is determined that the reverse gate operator 77 is not actuated, then at step 308 the ECU 200 sends a signal to the reverse gate actuator 218 to move the reverse gate 110 to the stowed position (unless the reverse gate 110 is already in the stowed position). Then at step 310, the throttle operator position sensor 202 senses the position of the throttle operator 76 and sends a signal representative of this position to the ECU 200. Once it receives the signal indicative of the position of the throttle operator 76, at step 312 the ECU 200 sends a signal to the throttle valve actuator 210 to control the speed of rotation of the engine 22 based at least on the position of the throttle operator 76 sensed at step 310. From step 312, the method 300 resumes at step 304.

If at step 306 it is determined that the reverse gate operator 77 is actuated, then at step 314 the watercraft speed sensor 208 senses a speed of the watercraft 10 and sends a signal representative of this speed to the ECU 200. Then at step 316, the ECU 200 determines if the speed sensed at step 314 is greater than a predetermined watercraft speed V1. The predetermined watercraft speed V1 is a speed of the watercraft 10 above which generating too much thrust with the jet propulsion system 84 while the reverse gate 110 is in a position in which it redirects the jet of water being expelled by the jet propulsion system 84 could result in the stern of the watercraft 10 lifting and the bow 56 of the watercraft 10 dipping. It is contemplated that the predetermined watercraft speed V1 could be a speed above which the ECU 200 enters a controlled deceleration mode (steps 320 to 342 described below) to slow down the watercraft 10 and at, or below which the ECU 200 enters a reverse mode (steps 310, 312, and 318) to reverse the direction of travel of the watercraft 10 (or keep it in position). In either case, the predetermined watercraft speed V1 will vary from one type of watercraft to the other. It is contemplated that at step 316, the ECU 200 could determine if the speed sensed at step 314 is greater than or equal to the predetermined watercraft speed V1. It is also contemplated that the predetermined watercraft speed V1 could be a speed of the watercraft 10 slightly below the speed above which generating too much thrust could result in the stern of the watercraft 10 lifting and the bow 56 of the watercraft 10 dipping.

If at step 316 it is determined that the speed of the watercraft 10 is less than or equal to the predetermined watercraft speed V1, then at step 318 the ECU 200 sends a signal to the reverse gate actuator 218 to move the reverse gate 110 to a position in which it redirects the jet of water being expelled by the jet propulsion system 84. The position to which the reverse gate 110 is moved is based on the position of the reverse gate operator 77 sensed at step 304. In a preferred embodiment, for step 318, each position of the reverse gate operator 77 has a corresponding position of the reverse gate 110. However it is contemplated that inputs from other sensors could be taken into account by the ECU 200 in addition to the position of the reverse gate operator 77 to determine the position to which the reverse gate 110 should be moved. From step 318, the method 300 goes step 310 and continues to step 312. At step 312, the ECU 200 sends a signal to the throttle valve actuator 210 to control the speed of rotation of the engine 22 based at least on the position of the throttle operator 76 sensed at step 310 and the position of the reverse gate operator 77 sensed at step 304. In an alternative embodiment, shown with the dashed line, from step 318, the method 318 goes to step 312, and at step 312 the ECU 200 sends a signal to the throttle valve actuator 210 to control the speed of rotation of the engine 22 based on the position of the reverse gate operator 77 sensed at step 304, independently of the position of the throttle operator 76.

If at step 316 it is determined that the speed of the watercraft 10 is greater than the predetermined watercraft speed V1, the ECU 200 enters a controlled deceleration mode, then at step 320 the engine speed sensor 208 senses a speed of rotation of the engine 22 and sends a signal representative of this speed to the ECU 200. Then at step 322, the ECU 200 determines if the speed of rotation of the engine 22 is greater than a reverse gate actuation speed RPM1. The reverse gate actuation speed RPM1 is a speed of rotation of the engine 22 above which the resulting thrust generated by the jet propulsion system 84 would be too high to lower the reverse gate 110 (i.e. attempting to do so would make the reverse gate 110 either go back to the stowed position due to the thrust or the handling of the watercraft could be compromised). The reverse gate actuation speed RPM1 will vary from one type of watercraft to the other as it is dependent on the features of the jet propulsion system (dimensions, impeller and stator shape and size) as well as the geometry and size of the reverse gate 110.

If at step 322 it is determined that the speed of rotation of the engine 22 sensed at step 320 is greater than the reverse gate actuation speed RPM1, then at step 324 the ECU 200 sends a signal to the throttle valve actuator 210 to move the throttle valve 216 in order to reduce a degree of opening of the throttle valve 216 so as to reduce the speed of rotation of the engine 22. From step 324, the method returns to step 320 and steps 320 to 324 are repeated until the speed of rotation of the engine 22 is at or less than the reverse gate actuation speed RPM1.

If at step 322 it is determined that the speed of rotation of the engine 22 sensed at step 320 is at or less than the reverse gate actuation speed RPM1, then at step 326 the ECU 200 sends a signal to the reverse gate actuator 218 to move the reverse gate to a position in which the reverse gate 110 redirects the jet of water 85 being expelled from the jet propulsion system 84 at least in part towards the front of the watercraft, as shown in FIG. 11. The position to which the reverse gate 110 is moved is preferably independent of the position of the reverse gate operator 77 sensed at step 304 as doing so could, in some cases result in too much reverse thrust being generated and/or could damage the reverse gate 110. The position to which the reverse gate 110 is moved is determined based on other inputs to the ECU 200 such as the speed of the watercraft 10 sensed at step 314 and/or the speed of rotation of the engine 22 sensed at step 320. It is contemplated that the ECU 200 could send a signal to the reverse gate actuator 218 to continuously adjust the position of the reverse gate 110 as the watercraft 10 decelerates and the speed of rotation of the engine 22 varies. It is also contemplated that the position to which the reverse gate 110 is moved could be based at least in part on the position of the reverse gate operator 77 sensed at step 304 for at least a range of positions of the reverse gate operator 77. It is also contemplated that the position to which the reverse gate 110 is moved could be a predetermined position, such as the fully lowered position of the reverse gate 110, independent of the position of the reverse gate operator 77.

From step 326, the method continues to step 328 where the ECU 200 sends a signal to the throttle valve actuator 210 to move the throttle valve 216 in order to increase a degree of opening of the throttle valve 216 so as to increase the speed of rotation of the engine 22. Then at step 330, the engine speed sensor 208 senses a speed of rotation of the engine 22 and sends a signal representative of this speed to the ECU 200. Then at step 332, the ECU 200 determines if the speed of rotation of the engine 22 is greater than the reverse gate actuation speed RPM1. If the speed of rotation of the engine 22 is not greater than the reverse gate actuation speed RPM1, then from step 332, the method returns to step 328 and steps 328 to 332 are repeated until the speed of rotation of the engine 22 is greater than the reverse gate actuation speed RPM1. If at step 332 it is determined that the speed of rotation of the engine 22 is greater than the reverse gate actuation speed RPM1, the method 300 continues to step 334. It is contemplated that steps 328 to 332 could be omitted and that the ECU 200 could go directly from step 326 to step 334.

At step 334, the ECU 200 sends a signal to the throttle valve actuator 210 in order to control the speed of rotation of the engine 22 such that the thrust generated by the redirected water jet 85 results in a controlled deceleration of the watercraft 10. The speed of rotation of the engine 22 is adjusted throughout the controlled deceleration. It is contemplated that at step 334 the speed of rotation of the engine 22 could be controlled so as to provide thrust in bursts. The controlled deceleration continues until either the watercraft 10 is moving at or below a predetermined watercraft speed V2 or the reverse gate operator 77 is no longer being actuated as described below with respect to steps 336 to 344. The signal sent by the ECU 200 at step 334 is preferably determined independently of the position of the throttle operator 76, since adjusting the position of the throttle valve 216 based on the position of the throttle operator 76 might not result in the desired controlled deceleration. However, it is contemplated that the signal sent by the ECU 200 at step 334 could be based in part on the position of the throttle operator 76. For example, the rate of deceleration of the watercraft 10 could be increased or decreased based on the position of the throttle operator 76. The signal sent by the ECU 200 at step 334 is preferably based on the speed of the watercraft 10 sensed at step 314 and the position of the reverse gate operator 77 sensed at step 304. It is contemplated that the signal sent by the ECU 200 at step 334 could also be based at least in part on engine speed. It is contemplated that an accelerometer (not shown) could be used instead of or in addition to the watercraft speed sensor 208 to provide a signal to the ECU 200 to control the speed of rotation of the engine 22 so as to obtain a controlled deceleration. It is contemplated that other inputs to the ECU 200 could also be used.

From step 334, the method 300 goes to step 336 where the watercraft speed sensor 208 senses a speed of the watercraft 10 and sends a signal representative of this speed to the ECU 200. Then at step 338, the ECU 200 determines if the speed sensed at step 336 is less than or equal to a predetermined watercraft speed V2. The predetermined watercraft speed V2 is a low watercraft speed. It is contemplated that the predetermined watercraft speed V2 could be 0 km/h. If at step 338 the speed of the watercraft 10 sensed at step 336 is less than or equal to the predetermined watercraft speed V2, then the method 300 goes to step 344 described below. If at step 338 the speed of the watercraft 10 sensed at step 336 is greater than the predetermined watercraft speed V2, then at step 340 the reverse gate operator position sensor 204 senses the position of the reverse gate operator 77 and sends a signal representative of this position to the ECU 200. At step 342, the ECU 200 determines if the reverse gate operator 77 is actuated. If at step 342 it is determined that the reverse gate operator 77 is not actuated, then the method 300 goes to step 344 described below. If at step 342 it is determined that the reverse gate operator 77 is actuated, then the method 300 returns to step 334. Note that when step 334 is being carried out following step 342, it is the speed of the watercraft 10 sensed at step 336 and the position of the reverse gate operator 77 sensed at step 340 that are used by the ECU 200 to determine the signal sent to the throttle valve actuator 210. In one embodiment, as the speed of the watercraft 10 decreases, the speed of rotation of the engine 22 is increased at step 334. Also, if the position of the reverse gate operator 77 has increased or decreased at step 340 (i.e. more or less deceleration is desired), then the level of increase of the speed of rotation of the engine 22 at step 334 is adjusted accordingly.

At step 344, the ECU 200 sends a signal to the reverse gate actuator 218 to move the reverse gate 110 to the neutral position. From step 344, the method resumes at step 304. It is contemplated that step 344 could be omitted, and that the method 300 could go directly from steps 338 and 342 to step 304. It is also contemplated that step 344 could be replaced by a step where the ECU 200 could send a signal to the reverse gate actuator 218 to move the reverse gate 110 to the stowed position instead of the neutral position.

It is contemplated that the reverse gate 110 could be actuated directly by the reverse gate operator 77 (i.e. the reverse gate actuator 210 would not be actuated as a result of a signal sent by the ECU 200). As a result, the reverse gate 110 would move to a position other than the stowed position directly as a result of the reverse gate operator 77 being actuated. Therefore, in such a case, some of the steps of the method 300 would be omitted or modified accordingly. However, the modified method would still result the thrust being generated by the jet propulsion assembly 84 to be controlled independently of the position of the throttle operator 76 when the reverse gate actuator 77 is actuated and the watercraft 10 is moving at a speed greater than the predetermined watercraft speed V1.

In the method 300, it is contemplated that when the speed of the watercraft 10 is less than or equal to the predetermined watercraft speed V1 and the reverse gate 110 has been moved as a result of step 318, that the maximum speed of rotation of the engine 22 could be limited to a first predetermined maximum engine speed at step 312, and that when the speed of the watercraft 10 is greater than the predetermined watercraft speed V1 and the reverse gate 110 has been moved as a result of step 326, that the maximum speed of rotation of the engine 22 could be limited to a second predetermined maximum engine speed at step 334. The second predetermined maximum engine speed being less than the first predetermined engine speed in order to prevent the watercraft 10 from pitching forward at high watercraft speed. It is contemplated that the second predetermined maximum engine speed could be variable, such that as the speed of the watercraft 10 decreases, the second predetermined maximum engine speed increases. It is also contemplated that in such an embodiment, the signal sent by the ECU 200 to the throttle valve actuator 210 at steps 312 and 334 could be either at least in part or fully independent of the position of the throttle operator 76 as described above, or based on the position of the throttle operator 76. It is also contemplated that instead of controlling the engine 22 so as not to exceed a first and a second predetermined maximum engine speed, that the ECU 200 could control the engine 22 (and jet propulsion system 84 if applicable) so a not to exceed a first and second predetermined maximum thrust generated by the jet propulsion system 84. The second predetermined maximum thrust being less than the first predetermined maximum thrust.

Turning now to FIG. 15, the method 400 is initiated at step 402. Then at step 404, the ECU 200 sends a signal to the reverse gate actuator 218 to move the reverse gate 110 to the neutral position. By moving the reverse gate 110 to the neutral position upon initiating the method 400, the personal watercraft 10 will not be accelerated forwardly or rearwardly by the thrust generated by the engine 22 when it is started. Then at step 406, the reverse gate operator position sensor 204 senses the position of the reverse gate operator 77 and sends a signal representative of this position to the ECU 200. At step 408, the ECU 200 determines if the reverse gate operator 77 is actuated.

If at step 408 it is determined that the reverse gate operator 77 is actuated, then the method 400 proceeds as in the method 300 (i.e. goes to step 314 and then to steps 316 to 344). For simplicity, these steps have not been reproduced in FIG. 15 and will not be described again. Note that in the method 400, step 344 returns to step 406, instead of step 304 as in the method 300. Also note that in the method 400, the step 318 goes to step 412 described below, instead of step 310 as in the method 300.

If at step 408 it is determined that the reverse gate operator 77 is not actuated, then at step 410 the ECU 200 determines if the reverse gate 110 is stowed based on the signal received from a reverse gate position sensor (not shown) or a feedback signal from the reverse gate actuator 218.

If at step 410 it is determined that the reverse gate 110 is stowed, then the ECU 200 proceeds to step 412. At step 412, the throttle operator position sensor 202 senses the position of the throttle operator 76 and sends a signal representative of this position to the ECU 200. Once it receives the signal indicative of the position of the throttle operator 76, at step 414 the ECU 200 sends a signal to the throttle valve actuator 210 to control the speed of rotation of the engine 22 based at least on the position of the throttle operator 76 sensed at step 412. From step 414, the method 400 returns to step 406.

If at step 410 it is determined that the reverse gate 110 is not in the stowed position, then the ECU 200 proceeds to step 416. At step 416, the ECU 200 determines if the throttle operator 76 was engaged when the engine 22 was started based on the signal received from the throttle operator position sensor 202 when the engine 22 was started. If the throttle operator 76 was not engaged when the engine 22 was started, then the ECU 200 proceeds to step 422. If at step 416 it is determined that the throttle operator 76 was engaged when the engine 22 was started, then at step 418 the ECU 200 determines if the throttle operator 76 has been returned to its idle position since the engine 22 was started based on the signals received from the throttle operator position sensor 202 since the engine 22 was started. If the throttle operator 76 has not been returned to its idle position since the engine 22 was started, then at step 420 the throttle operator position sensor 202 senses the position of the throttle operator 76 and the ECU 200 returns to step 418 to determine if the throttle operator 76 has now been returned to its idle position. Steps 418 and 420 are repeated until the throttle operator 76 is returned to its idle position. If at step 420 the position of the throttle operator 76 sensed by the throttle operator position sensor 202 is the idle position, then from step 418 the ECU proceeds to step 422. If at step 418 it is determined that the throttle operator 76 has been returned to its idle position since the engine 22 was started, then the ECU 200 proceeds to step 422. Steps 416 to 420 prevent a sudden amount of thrust to be generated by the jet propulsion system 84 at engine start-up. In the method 400, at engine start-up, since the reverse gate 110 is in the neutral position as a result of step 404, applying a sudden amount of thrust could cause the transom 54 to lift, thus possibly causing a driver of the personal watercraft 10 to lose his balance.

At step 422 the throttle operator position sensor 202 senses the position of the throttle operator 76 and the ECU 200 then proceeds to step 424. At step 424, the ECU 200 determines if a rate of change in the position of the throttle operator 76 is greater than a predetermined amount X. If the rate of change in the position of the throttle operator 76 is greater than the predetermined amount X, then the ECU 200 returns to step 422 and steps 424 and 422 are repeated until the rate of change in the position of the throttle operator 76 is not greater than the predetermined amount X. If at step 424 the rate of change in the position of the throttle operator 76 is not greater than the predetermined amount X, then the ECU 200 proceeds to step 428.

In an alternative embodiment shown in dashed lines, from step 422 the ECU 200 proceeds to step 426. At step 426, the ECU 200 determines if the position of the throttle operator 76 is greater than a predetermined amount Y. If the position of the throttle operator 76 is greater than the predetermined amount Y, then the ECU 200 returns to step 422 and steps 426 and 422 are repeated until the position of the throttle operator 76 is not greater than the predetermined amount Y. If at step 426 the position of the throttle operator 76 is not greater than the predetermined amount Y, then the ECU 200 proceeds to step 428.

Both steps 424 and 426 prevent a sudden amount of thrust to be generated by the jet propulsion system 84 when the reverse gate operator 77 is not actuated (step 408) and the reverse gate 110 is not in the stowed position (step 410), thus preventing the aforementioned problem of the transom 54 possibly lifting.

At step 428, the ECU 200 sends a signal to the reverse gate actuator 218 to move the reverse gate 110 to the stowed position and then proceeds to step 412 (thus allowing the watercraft 10 to accelerate).

Turning now to FIG. 16, the method 500 will be described. It is contemplated that the method 500 could be carried out at the same time as the method 300 or 400. The method 500 is initiated at step 502. Then at step 504, the ECU 200 determines if the engine 22 is being started. If the engine 22 is being started, then at step 506 the ECU 200 sends a signal to the reverse gate actuator 218 to move the reverse gate 110 to the neutral position (unless the reverse gate 110 is already in the neutral position). The ECU 200 then proceeds to step 508. If at step 504, the ECU 200 determines that the engine 22 is not being started (i.e. the engine 22 is already running or is stopped), then the ECU proceeds to step 508.

At step 508, the ECU 200 determines if the engine 22 is being stopped. If the engine 22 is stopped, then at step 510 the ECU 200 sends a signal to the reverse gate actuator 218 to move the reverse gate 110 to the neutral position (unless the reverse gate 110 is already in the neutral position). The ECU 200 then returns to step 504. If at step 508, the ECU 200 determines that the engine 22 is not stopped, then the ECU proceeds to step 512.

At step 512 the throttle operator position sensor 202 senses the position of the throttle operator 76 and the ECU 200 then proceeds to step 514. At step 514, the ECU 200 determines if the throttle operator 76 is in the idle position. If the throttle operator 76 is not in the idle position, the ECU 200 returns to step 508. If the throttle operator 76 is in the idle position, then at step 516 the ECU 200 determines if the throttle operator has been in the idle position for longer than a predetermined time t1. For example, the time t1 could be 10 minutes. If the throttle operator 76 has been in the idle position for longer than the predetermined time t1, then the ECU 200 returns to step 506 and sends a signal to the reverse gate actuator 218 to move the reverse gate 110 to the neutral position (unless the reverse gate 110 is already in the neutral position). If at step 516 it is determined that the throttle operator 76 has not been in the idle position for longer than the predetermined time t1, then the ECU 200 proceeds to step 518.

At step 518, the reverse gate operator position sensor 204 senses the position of the reverse gate operator 77 and sends a signal representative of this position to the ECU 200. Then at step 520, the ECU 200 determines if the reverse gate operator 77 has been actuated for less than a predetermined amount of time t2 before being released. In one exemplary embodiment, the predetermined amount of time t2 corresponds to an amount of time it takes a user of the watercraft 10 to actuate and then almost immediately release the reverse gate operator 77. For example, the time t2 could be half a second. If the reverse gate operator 77 has not been actuated for less than the predetermined amount of time t2 before being released, then the ECU 200 returns to step 508. If at step 520, it is determined that reverse gate operator 77 has been actuated for less than a predetermined amount of time t2 before being released, then the ECU 200 returns to step 506 and sends a signal to the reverse gate actuator 218 to move the reverse gate 110 to the neutral position (unless the reverse gate 110 is already in the neutral position).

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A method of controlling a watercraft, the watercraft having a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull, the reverse gate being movable between a first stowed position and a second position in which the reverse gate redirects a jet of water expelled from the jet propulsion system, the reverse gate being in operative connection with the reverse gate operator, the method comprising:

actuating the reverse gate operator;

sensing a speed of the watercraft;

sensing a position of the throttle operator;

controlling a thrust generated by the jet propulsion system based at least on the position of the throttle operator when the reverse gate operator is actuated and the speed of the watercraft is below a predetermined watercraft speed;

controlling the thrust generated by the jet propulsion system at least in part independently of the position of the throttle operator when the reverse gate operator is actuated and the speed of the watercraft is above the predetermined watercraft speed; and moving the reverse gate to the second position in response to the actuation of the reverse gate operator.

2. The method of claim 1, wherein when the reverse gate operator is actuated and the speed of the watercraft is above the predetermined watercraft speed, the thrust generated by the jet propulsion system is controlled independently of the position of the throttle operator.

3. The method of claim 1, wherein controlling the thrust generated by the jet propulsion system includes controlling a speed of rotation of the engine.

4. The method of claim 3, wherein, when the reverse gate operator is actuated and the speed of the watercraft is above the predetermined watercraft speed:

controlling the speed of rotation of the engine includes controlling the speed of rotation of the engine to be at or below a reverse gate actuation speed in response to the actuation of the lever;

the reverse gate is moved to the second position once the speed of rotation of the engine is at or below the reverse gate actuation speed; and once the reverse gate is moved to the second position, controlling the speed of rotation of the engine includes controlling the speed of rotation of the engine in order to decelerate the watercraft.

5. The method of claim 4, wherein controlling a speed of rotation of the engine in order to decelerate the watercraft includes increasing the speed of rotation of the engine above the reverse gate actuation speed.

6. The method of claim 3, wherein controlling the speed of rotation of the engine comprises adjusting a position of a throttle valve of the engine.

7. The method of claim 3, wherein controlling the speed of rotation of the engine comprises adjusting at least one of an ignition timing and an injection timing of the engine.

8. The method of claim 1, further comprising sensing an actuated position of the reverse gate operator; and wherein, when the reverse gate operator is actuated and the speed of the watercraft is below the predetermined watercraft speed, moving the reverse gate to the second position includes adjusting the second position of the reverse gate based at least on the actuated position of the reverse gate operator.

9. The method of claim 8, wherein, when the reverse gate operator is actuated and the speed of the watercraft is above the predetermined watercraft speed, moving the reverse gate to the second position includes adjusting the second position of the reverse gate independently of an actuated position of the reverse gate operator.

10. The method of claim 1, further comprising adjusting a position of a throttle valve of the engine based on the position of the throttle operator when the reverse gate operator is not actuated.

11. The method of claim 1, further comprising sensing an actuated position of the reverse gate operator; and wherein controlling the thrust generated by the jet propulsion system at least in part independently of the position of the throttle operator when the reverse gate operator is actuated and the speed of the watercraft is above the predetermined watercraft speed includes controlling the thrust generated by the jet propulsion system based at least on the speed of the watercraft and the position of the reverse gate operator.

12. The method of claim 1, wherein, when the reverse gate operator is actuated and the speed of the watercraft is above the predetermined watercraft speed, the second position of the reverse gate is a predetermined position independent of the position of the reverse gate operator.

13. The method of claim 1, further comprising sensing an actuated position of the reverse gate operator; and wherein controlling the thrust generated by the jet propulsion system at least in part independently of the position of the throttle operator when the reverse gate operator is actuated and the speed of the watercraft is above the predetermined watercraft speed includes adjusting the thrust generated by the jet propulsion system based on changes in the position of the reverse gate operator.

14. The method of claim 1, further comprising:

returning the reverse gate operator to a non-actuated position; and moving the reverse gate to a neutral position in response to the reverse gate operator returning to the non-actuated position.

15. The method of claim 1, wherein controlling the thrust generated by the jet propulsion system at least in part independently of the position of the throttle operator when the reverse gate operator is actuated and the speed of the watercraft is above the predetermined watercraft speed includes:

controlling the thrust generated by the jet propulsion system at least in part independently of the position of the throttle operator when the reverse gate operator is actuated and the speed of the watercraft is above the predetermined watercraft speed until the speed of the watercraft is less than or equal to an other predetermined watercraft speed, the other predetermined watercraft speed being less than the predetermined watercraft speed;

the method further comprising moving the reverse gate to a neutral position when the speed of the watercraft is less than or equal to the other predetermined watercraft speed.

16. A watercraft comprising:

a hull;

a deck disposed on the hull;

an engine compartment defined between the hull and the deck;

an engine disposed in the engine compartment;

a throttle body having a throttle valve and being in fluid communication with the engine;

a jet propulsion system connected to the hull and operatively connected to the engine;

an electronic control unit (ECU) associated with the watercraft for controlling at least an operation of the engine;

a throttle operator being movable between an idle position and an actuated position;

a throttle operator position sensor associated with the throttle operator for sensing a position of the throttle operator, the throttle operator position sensor being in electronic communication with the ECU;

a throttle valve actuator operatively connected to the throttle valve and in electronic communication with the ECU;

an engine speed sensor for sensing a speed of rotation of the engine and being in electronic communication with the ECU;

a watercraft speed sensor for sensing a speed of the watercraft and being in electronic communication with the ECU;

a reverse gate operatively connected to the hull, the reverse gate being movable between a first stowed position and a second position in which the reverse gate redirects a jet of water expelled from the jet propulsion system;

a reverse gate actuator operatively connected to the reverse gate for moving the reverse gate between the first stowed position and the second position, and being in electronic communication with the ECU; and a reverse gate operator associated with the watercraft and being in electronic communication with the ECU for controlling the reverse gate actuator, the ECU causing the reverse gate actuator to move the reverse gate to the second position when the reverse gate operator is actuated, the ECU sending a first signal to the throttle valve actuator to control the throttle valve actuator when the reverse gate operator is actuated and the speed of the watercraft is below a predetermined watercraft speed, the first signal being based at least on the position of the throttle operator, and the ECU sending a second signal to the throttle valve actuator to control the throttle valve actuator when the reverse gate operator is actuated and the speed of the watercraft is above the predetermined watercraft speed, the second signal being independent at least in part of the position of the throttle operator.

17. The watercraft of claim 16, wherein the second signal is independent of the position of the throttle operator.

18. The watercraft of claim 16, wherein the second signal controls the throttle valve actuator such that the speed of rotation of the engine is controlled to be at or below a reverse gate actuation speed;

wherein when the second signal is sent to the throttle valve actuator, the ECU causes the reverse gate actuator to move the reverse gate to the second position once the speed of rotation of the engine is at or below the reverse gate actuation speed; and wherein, once the reverse gate is moved to the second position, the second signal controls the throttle valve actuator such that the watercraft decelerates in a controlled deceleration.

19. The watercraft of claim 18, wherein, once the reverse gate is moved to the second position, the second signal controls the throttle valve actuator such that the speed of rotation of the engine is increased above the reverse gate actuation speed.

20. The watercraft of claim 16, further comprising a reverse gate operator position sensor associated with the reverse gate operator for sensing a position of the reverse gate operator, the reverse gate operator position sensor being in electronic communication with the ECU; and wherein when the first signal is sent to the throttle valve actuator, the ECU causes the reverse gate actuator to move the reverse gate to the second position based at least on the position of the reverse gate operator.

21. The watercraft of claim 20, wherein when the second signal is sent to the throttle valve actuator, the ECU causes the reverse gate actuator to move the reverse gate to the second position independently of the position of the reverse gate operator.

22. The watercraft of claim 16, wherein the ECU sends a third signal to the throttle valve actuator to control the throttle valve actuator when the reverse gate operator is not actuated, the third signal being based at least on the position of the throttle operator.

23. The watercraft of claim 16, further comprising a reverse gate operator position sensor associated with the reverse gate operator for sensing a position of the reverse gate operator, the reverse gate operator position sensor being in electronic communication with the ECU; and wherein the second signal is based at least on the speed of the watercraft and the position of the reverse gate operator.

24. The watercraft of claim 16, further comprising a handlebar operatively connected to the deck;

wherein the throttle operator is disposed on the handlebar; and wherein the throttle operator is selected from a group consisting of a thumb-actuated throttle lever, a finger-actuated throttle lever, and a twist grip.

25. The watercraft of claim 16, wherein the reverse gate actuator is an electric actuator.

26. The watercraft of claim 16, wherein, when the reverse gate operator is actuated and the speed of the watercraft is above the predetermined watercraft speed, the second position of the reverse gate is a predetermined position independent of the position of the reverse gate operator.

27. The watercraft of claim 16, further comprising a reverse gate operator position sensor associated with the reverse gate operator for sensing a position of the reverse gate operator, the reverse gate operator position sensor being in electronic communication with the ECU; and wherein the second signal is based on changes in the position of the reverse gate operator.

28. The watercraft of claim 16, wherein the ECU causes the reverse gate actuator to move the reverse gate to a neutral position when the reverse gate actuator is returned to a non-actuated position from an actuated position.

29. The watercraft of claim 16, wherein the ECU stops sending the second signal when the speed of the watercraft becomes less than or equal to an other predetermined watercraft speed, the other predetermined watercraft speed being less than the predetermined watercraft speed;

wherein the ECU causes the reverse gate actuator to move the reverse gate to a neutral position when the ECU stops sending the second signal.

30. A method of controlling a watercraft, the watercraft having a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull, the reverse gate being movable between a first stowed position and a second position in which the reverse gate redirects a jet of water expelled from the jet propulsion system, the reverse gate being in operative connection with the reverse gate operator, the method comprising:

actuating the reverse gate operator;

sensing a speed of the watercraft;

sensing a position of the throttle operator;

moving the reverse gate to the second position in response to the actuation of the reverse gate operator;

controlling a thrust generated by the jet propulsion system to be less than or equal to a first predetermined maximum thrust when the reverse gate operator is actuated and the speed of the watercraft is below a predetermined watercraft speed; and controlling the thrust generated by the jet propulsion system to be less than or equal to a second predetermined maximum thrust when the reverse gate operator is actuated and the speed of the watercraft is above the predetermined watercraft speed, the second predetermined maximum thrust being less than the first predetermined maximum thrust.

31. The method of claim 30, wherein the second predetermined maximum thrust increases as the speed of the watercraft decreases.

32. The method of claim 30, wherein controlling the thrust generated by the jet propulsion system includes controlling a speed of rotation of the engine.

33. The method of claim 32, wherein, when the reverse gate operator is actuated and the speed of the watercraft is above the predetermined watercraft speed:

controlling the speed of rotation of the engine includes controlling the speed of rotation of the engine to be at or below a reverse gate actuation speed in response to the actuation of the lever;

the reverse gate is moved to the second position once the speed of rotation of the engine is at or below the reverse gate actuation speed; and once the reverse gate is moved to the second position, controlling the speed of rotation of the engine includes controlling the speed of rotation of the engine in order to decelerate the watercraft.

34. A watercraft comprising:

a hull;

a deck disposed on the hull;

an engine compartment defined between the hull and the deck;

an engine disposed in the engine compartment;

a throttle body having a throttle valve and being in fluid communication with the engine;

a jet propulsion system connected to the hull and operatively connected to the engine;

an electronic control unit (ECU) associated with the watercraft for controlling at least an operation of the engine;

a throttle operator being movable between an idle position and an actuated position;

a throttle operator position sensor associated with the throttle operator for sensing a position of the throttle operator, the throttle operator position sensor being in electronic communication with the ECU;

a throttle valve actuator operatively connected to the throttle valve and in electronic communication with the ECU;

an engine speed sensor for sensing a speed of rotation of the engine and being in electronic communication with the ECU;

a watercraft speed sensor for sensing a speed of the watercraft and being in electronic communication with the ECU;

a reverse gate operatively connected to the hull, the reverse gate being movable between a first stowed position and a second position in which the reverse gate redirects a jet of water expelled from the jet propulsion system;

a reverse gate actuator operatively connected to the reverse gate for moving the reverse gate between the first stowed position and the second position, and being in electronic communication with the ECU; and a reverse gate operator associated with the watercraft and being in electronic communication with the ECU for controlling the reverse gate actuator, the ECU causing the reverse gate actuator to move the reverse gate to the second position when the reverse gate operator is actuated, the ECU sending a first signal to the throttle valve actuator to control the throttle valve actuator when the reverse gate operator is actuated and the speed of the watercraft is below a predetermined watercraft speed, a thrust generated by the jet propulsion system as a result of the first signal being sent to the throttle valve actuator being less than or equal to a first predetermined maximum thrust, the ECU sending a second signal to the throttle valve actuator to control the throttle valve actuator when the reverse gate operator is actuated and the speed of the watercraft is above the predetermined watercraft speed, the thrust generated by the jet propulsion system as a result of the second signal being sent to the throttle valve actuator being less than or equal to a second predetermined maximum thrust, and the second predetermined maximum thrust being less than the first predetermined maximum thrust.

35. The watercraft of claim 34, wherein the second predetermined maximum thrust increases as the speed of the watercraft decreases.

36. The watercraft of claim 34, wherein the second signal controls the throttle valve actuator such that the speed of rotation of the engine is controlled to be at or below a reverse gate actuation speed;

wherein when the second signal is sent to the throttle valve actuator, the ECU causes the reverse gate actuator to move the reverse gate to the second position once the speed of rotation of the engine is at or below the reverse gate actuation speed; and wherein, once the reverse gate is moved to the second position, the second signal controls the throttle valve actuator such that the watercraft decelerates in a controlled deceleration.

37. A method of controlling a watercraft, the watercraft having a hull, a deck disposed on the hull, a seat disposed on the deck, an engine compartment defined between the hull and the deck, an engine disposed in the engine compartment, an electronic control unit, a jet propulsion system connected to the hull and operatively connected to the engine, a throttle operator for controlling the engine, a reverse gate operator, and a reverse gate operatively connected to the hull, the reverse gate being movable between a first stowed position, a second position in which the reverse gate redirects a jet of water expelled from the jet propulsion system, and a neutral position intermediate the first stowed position and the second position, the reverse gate being in operative connection with the reverse gate operator, the method comprising:

a) actuating the reverse gate operator;

b) sensing a speed of the watercraft;

c) controlling the thrust generated by the jet propulsion system in a reverse mode when the reverse gate operator is actuated and the speed of the watercraft is below a predetermined watercraft speed;

d) controlling the thrust generated by the jet propulsion system in a controlled deceleration mode when the reverse gate operator is actuated and the speed of the watercraft is above the predetermined watercraft speed;

e) moving the reverse gate to the second position in response to the actuation of the reverse gate operator;

f) returning the reverse gate operator to a non-actuated position after the actuation of the reverse gate operator; and g) moving the reverse gate to the neutral position in response to the reverse gate operator returning to the non-actuated position.

38. The method of claim 37, wherein steps c, d, and e are only carried out if the reverse gate operator has been actuated for a predetermined amount of time.

* * * * *